US008790174B2

(12) United States Patent
Okuaki

(10) Patent No.: US 8,790,174 B2
(45) Date of Patent: Jul. 29, 2014

(54) DRAWING MACHINE FOR JACKPOT GAME, AND GAME MACHINE AND GAME SYSTEM USING THE SAME

(75) Inventor: Masato Okuaki, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 1450 days.

(21) Appl. No.: 12/223,930

(22) PCT Filed: Feb. 9, 2007

(86) PCT No.: PCT/JP2007/052332

§ 371 (c)(1),
(2), (4) Date: Aug. 13, 2008

(87) PCT Pub. No.: WO2007/094250

PCT Pub. Date: Aug. 23, 2007

(65) Prior Publication Data

US 2010/0160020 A1 Jun. 24, 2010

(30) Foreign Application Priority Data

Feb. 15, 2006 (JP) ..... 2006-037831

(51) Int. Cl.
*G07F 17/32* (2006.01)

(52) U.S. Cl.
USPC ..... 463/17; 463/26

(58) Field of Classification Search
CPC ..... G07F 17/3244; G07F 17/3246; G07F 17/3248; G07F 17/3258
USPC ..... 463/16, 17, 25, 26
See application file for complete search history.

(56) References Cited

U.S. PATENT DOCUMENTS 5,957,774 A * 9/1999 Holmes et al. ..... 463/13
6,203,010 B1 * 3/2001 Jorasch et al. ..... 273/138.1

(Continued)

FOREIGN PATENT DOCUMENTS

EP 1513115 A2 3/2005
JP 2001-017730 A 1/2001

(Continued)

OTHER PUBLICATIONS

Written Opinion of the International Searching Agency mailed on Mar. 27, 2007.

(Continued)

*Primary Examiner* — Arthur O Hall
*Assistant Examiner* — Allen Chan

(57) ABSTRACT

The present invention provides a drawing machine for jackpot game, etc., capable of preventing reduction of the game attractiveness even when one player wins the jackpot prize.
A drawing machine for jackpot game having a drawing unit for carrying out a drawing to decide a winning in which any one of a plurality of types of jackpot prizes is awarded or a non-winning, includes: a storage unit for storing payout amount data indicating an amount of payout-objects to be paid out to a player when the drawing unit decides that any one of the plurality of types of jackpot prizes is awarded; a payout processing unit for executing a payout process in which, when the drawing unit decides that any one of the plurality of types of jackpot prizes is awarded, executing a data process of a plurality of payout amount data stored in the storage unit such that after the payout amount data corresponding to the type of the awarded jackpot prize is read from the storage unit, a payout amount decreasing process for decreasing an amount indicated by the payout amount data stored in the storage unit is executed, but the payout amount decreasing process of amounts corresponding to payout amount data other than the payout amount data is not executed; and a payout-amount increasing unit for increasing cumulatively an amount indicated by at least one of the plurality of payout amount data stored in the storage unit when a predetermined payout increasing condition are satisfied.

13 Claims, 23 Drawing Sheets

(56) References Cited

U.S. PATENT DOCUMENTS

| | | | | |
|---|---|---|---|---|
| 7,500,913 | B2 * | 3/2009 | Baerlocher | 463/16 |
| 7,651,394 | B2 * | 1/2010 | Johnson | 463/26 |
| 7,736,226 | B1 * | 6/2010 | Luciano, Jr. | 463/25 |
| 7,811,168 | B2 * | 10/2010 | Parham et al. | 463/27 |
| 7,871,328 | B2 * | 1/2011 | Parham et al. | 463/27 |
| 7,887,415 | B2 * | 2/2011 | Parham et al. | 463/27 |
| 2002/0074726 | A1 * | 6/2002 | Yoseloff et al. | 273/274 |
| 2005/0054426 | A1 * | 3/2005 | Toyoda | 463/20 |
| 2007/0202943 | A1 * | 8/2007 | Thomas | 463/27 |
| 2008/0102943 | A1 * | 5/2008 | Parham et al. | 463/27 |

FOREIGN PATENT DOCUMENTS

| | | | |
|---|---|---|---|
| JP | 2002-085811 | A | 3/2002 |
| JP | 2002-253842 | A | 9/2002 |
| JP | 2004-298576 | A | 10/2004 |
| JP | 2005-80861 | A | 3/2005 |
| JP | 2005-124922 | A | 5/2005 |
| JP | 2005-192891 | A | 7/2005 |
| TW | 592767 | | 6/2004 |
| TW | I244401 | B | 12/2005 |

OTHER PUBLICATIONS

International Search Report mailed on Mar. 27, 2007.

Konami Amusement Machine Catalogue, "GrandCross", Japan (2006).

Office Action of Patent Application No. 2006-037831 mailed on Feb. 20, 2009 (Japan).

Supplementary European Search Report for corresponding EP Application No. 07713988.9-2221, Jul. 23, 2010.

Korean Office Action for corresponding KR Application No. 10-2008-7016025.

Taiwanese Office Action for corresponding TW Application No. 096105566, Dec. 8, 2009.

Taiwanese Search Report, 096105566, Dec. 3, 1998.

* cited by examiner

DRAWING MACHINE FOR JACKPOT GAME, AND GAME MACHINE AND GAME SYSTEM USING THE SAME

TECHNICAL FIELD

The present invention relates to a drawing machine for jackpot game for drawing a jackpot prize in which a payout amount increases cumulatively when a predetermined payout increasing condition is satisfied, a game machine and a game system using the drawing machine.

BACKGROUND ART

Conventionally, this type of drawing machine for jackpot game has been known, for example, as a token-operated game machine (game machine) or a game system composed of a plurality of token-operated game machines installed in a gaming arcade or the like (Patent Document 1, for example). In general, token-operated game machines control the progression of a game on the condition that tokens (bet-objects) are received from a player and pay out to the player a predetermined number of tokens (payout-objects) according to the result of the game. A description is given of one example of a token-operated game machine utilizing a drawing machine for jackpot game. For example, the number of tokens corresponding to part of the number of tokens (bet-objects) received from a player is added cumulatively, which is retained as payout amount data at a storage unit of the drawing machine for jackpot game. Then, when a predetermined drawing start condition is satisfied, the drawing machine for jackpot game carries out a drawing, thereby decides whether a jackpot prize is awarded or not. When the jackpot prize is awarded by this drawing, the number of tokens shown by the payout amount data is paid out to the player who has satisfied the predetermined drawing start condition, and the payout amount data is restored to an initial value.

In this instance, a drawing machine for jackpot game is often used in general by a game machine having a plurality of gaming units that progress mutually independent games or a game system composed of a plurality of game machines that progress mutually independent games. This is based on the following reasons.

That is, the number of tokens which can be paid out at one time to a player by individual gaming units or individual game machines is limited to some extent in terms of a payout ratio which has been set in advance at individual gaming units or game machines. However, when a drawing machine for jackpot game is used, an upper limit of the number of tokens which can be paid out at one time can be determined in terms of a payout ratio to be set based on a plurality of gaming units or game machines. Thus, in the case of the above-described game machine or game system, it is possible to pay out a great number of tokens to a player at one time. As a result, a player will expect that a great number of tokens can be paid out at one time, by which the player's interest can be captured.

In addition, a game machine or a game system in which the above-described drawing machine for jackpot game is utilized may be installed not only in a gaming arcade or the like but also utilized in pachinko machines or slot machines installed in pachinko parlors.

Further, a game machine in which a drawing machine for jackpot game is utilized is not limited to that provided with a plurality of gaming units that progress mutually independent games. The drawing machine for jackpot game can be utilized, for example, even in a game machine for one player use.

Patent Document 1: Japanese Published Unexamined Patent Application No. 2002-253842

DISCLOSURE OF THE INVENTION

Problems to be Solved by the Invention

In the drawing machine for jackpot game, since an amount indicated by payout amount data corresponding to a jackpot prize is increased cumulatively, a player has a increasing desire to win the jackpot prize as the amount is increased, and game attractiveness is also enhanced. However, in a conventional drawing machine for jackpot game, only one jackpot prize can be generally awarded in the drawing, and only one piece of payout amount data corresponds to this jackpot prize. Therefore, there is a problem that when one player wins the jackpot prize and the payout amount data is restored to an initial value, other players who played the game with the one player at the same time or other players who will play the game subsequently may lose their willingness to win the jackpot prize, thereby the game attractiveness is drastically reduced.

The present invention realizes and provides a drawing machine for jackpot game capable of preventing reduction of the game attractiveness even when one player wins the jackpot prize, and a game machine and a game system using the same.

Means for Solving the Problem

As an aspect of the present invention, it is listed that a drawing machine for jackpot game having a drawing unit for carrying out a drawing to decide a winning in which any one of a plurality of types of jackpot prizes is awarded or a non-winning in which none of the plurality of types of jackpot prizes is awarded, includes: a storage unit for storing, by the plurality of types of jackpot prizes, payout amount data indicating an amount of payout-objects to be paid out to a player when the drawing unit decides that any one of the plurality of types of jackpot prizes is awarded; a payout processing unit for executing a payout process in which, when the drawing unit decides that any one of the plurality of types of jackpot prizes is awarded, payout amount data corresponding to the type of the awarded jackpot prize is read from the storage unit and an amount of payout-objects indicated by the read payout amount data is paid out to the player, and for executing a data process of a plurality of pieces of payout amount data stored in the storage unit such that after the payout amount data corresponding to the type of the awarded jackpot prize is read from the storage unit, a payout amount decreasing process for decreasing an amount indicated by the payout amount data stored in the storage unit is executed, but the payout amount decreasing process of amounts corresponding to payout amount data other than the payout amount data is not executed; and a payout-amount increasing unit for increasing cumulatively an amount indicated by at least one of the plurality of payout amount data stored in the storage unit when a predetermined payout increasing condition is satisfied.

In the present drawing machine for jackpot game, there is a plurality of types of jackpot prizes that can be awarded in one drawing carried out by a drawing unit. And, where one jackpot prize is awarded, payout-objects in an amount indicated by the payout amount data corresponding to this jackpot prize are paid out and an amount indicated by this payout amount data is restored to an initial value or reduced by a predetermined ratio, so that the amount is decreased so as to be less than the amount indicated by the payout amount data when the prize is awarded. However, in the present drawing machine for jackpot game, there is no decrease of the amounts indicated by the payout amount data corresponding to other jackpot prizes that have not been awarded. Therefore, even after one jackpot prize is awarded, a player will have a strong desire to win other jackpot prizes, and thus game attractiveness is not reduced at all. On the contrary, the game attractiveness can be further enhanced.

In addition, "non-winning" in this instance means that none of the jackpot prizes is awarded but does not mean that a player does not benefit in any way. Therefore, even where the non-winning is decided by the drawing carried out by the drawing unit, the player may be given some benefits such as payment of a predetermined amount of payout-objects.

In addition, in the drawing machine for jackpot game, the non-winning which can be decided by the drawing unit may include a payout-amount increasing prize, and the payout-amount increasing unit cumulatively may increase an amount indicated by the at least one of the plurality of payout amount data stored in the storage unit when the payout increasing condition in which the drawing unit decides the payout-amount increasing prize is satisfied.

In general, in a drawing machine for jackpot game, when a drawing is executed by one player, other players expect that no jackpot prize will be awarded by the drawing so that an amount paid out at the time, when they will win a jackpot prize in subsequent drawing, is not decreased. However, in a conventional drawing machine for jackpot game, even when one player does not win a jackpot prize by the drawing, other players only benefit to such an extent that there is consequently no decrease in the amount paid out when they will win a jackpot prize in subsequent drawing. Therefore, players are relatively less interested in a drawing by a player other than themselves, and the game attractiveness of the drawing is low for players other than the player who performs a drawing.

In the present drawing machine for jackpot game, even when none of the jackpot prizes is awarded by drawing carried out by the drawing unit and thereby the non-winning is decided, if this non-winning is a payout-amount increasing prize, there is an increase in the amount indicated by the payout amount data corresponding to at least one type of jackpot prize. Thereby, where the non-winning is decided by drawing for one player, there is a case where an amount of payout-objects will be increased, which is paid out when the jackpot prize is awarded in subsequent drawing. Therefore, where the non-winning is decided by drawing for other players, the player will benefit to such an extent that is greater than the mere fact that there is no decrease in the amount paid out when the player will win the jackpot prize in subsequent drawing. As a result, the player is made more interested in a drawing by players other than the player. Therefore, it is possible to enhance the game attractiveness for players other than a player who performs a drawing.

Also, in the drawing machine for jackpot game, the payout increasing condition may comprise two or more of payout increasing conditions which are different from each other, and when any one of the two or more of the payout increasing conditions is satisfied, the payout-amount increasing unit may cumulatively increase an amount indicated by the payout amount data corresponding to the satisfied payout increasing condition among the plurality of pieces of payout amount data stored in the storage unit.

In the present drawing machine for jackpot game, where one of the two or more of mutually different payout increasing conditions is satisfied, among the plurality of payout amount data individually corresponding to the plurality of types of jackpot prizes, only the payout amount of the payout amount data corresponding to the thus satisfied payout increasing condition is cumulatively increased. Thus, since there are the two or more of mutually different payout increasing conditions, it possible to diversify the conditions for increasing a payout amount of the jackpot prizes. As a result, it is possible to realize a higher game attractiveness.

As another aspect of the present invention, it is listed that a game machine includes: a drawing machine having a drawing unit for carrying out a drawing to decide a winning in which a jackpot prize is awarded or a non-winning in which the jackpot prize is not awarded, and a game control unit for controlling progression of a game, wherein the drawing machine for jackpot game is used as the drawing machine, and the drawing unit of the drawing machine for jackpot game starts the above drawing when a predetermined drawing start condition is satisfied by a progression of the game controlled by the game control unit.

In the game machine, when the predetermined drawing start condition is satisfied by the progression of the game, the drawing is started by the drawing machine for jackpot game. And, where the player wins the jackpot prize by the drawing, the player can receive a greater amount of payout-objects. Then, as described above, after one jackpot prize is awarded, the player experiences a strong desire to win other jackpot prizes. For this reason, the game attractiveness is not reduced at all, on the contrary the game attractiveness can be further enhanced. Therefore, even if one player wins a jackpot prize, the game attractiveness is not only prevented from being reduced but also the game attractiveness can be enhanced.

In addition, the game machine may further include a plurality of gaming units, each of which has the game control unit, wherein games are allowed to, independently on each other, progress by the game progress unit, wherein the payout processing unit of the drawing machine for jackpot game may execute a payout process for paying out an amount of the payout-objects indicated by the payout amount data read from the storage unit to player of the gaming unit which satisfies the predetermined drawing start condition when the drawing unit of the drawing machine for jackpot game decides the winning in which any one of the plurality of types of jackpot prizes is awarded.

In the game machine, a plurality of players is allowed to play at the same time, by using the plurality of gaming units. Also, in the game machine, the drawing machine for jackpot game is commonly used by the plurality of gaming units. Therefore, a player directly experiences during own play term that other players win the jackpot prize and the payout amount corresponding to the jackpot prize is decreased. As a result, where there is only one jackpot prize that can be awarded by the drawing, such a case of a drawing machine for jackpot game provided in a conventional game machine, if other players win a jackpot prize, there is a great reducing in the desire for winning the jackpot prize and the game attractiveness is more likely to reduce.

According to the present game machine, as described above, even after one jackpot prize is awarded, a player experiences a strong desire to win other jackpot prizes. Therefore, the game attractiveness is not reduced at all, on the contrary the game attractiveness can be further enhanced. This is quite beneficial to a game machine that a player directly experiences during own play term that other players win a jackpot prize and a payout amount corresponding to the jackpot prize is decreased.

As another aspect of the present invention, it is listed that a game system includes: a drawing machine having a drawing unit for carrying out a drawing to decide a winning which a jackpot prize is awarded or a non-winning which the jackpot prize is not awarded; and a plurality of game machines, each of which is connected to the drawing device via a communication network and has a game control unit for controlling progression of a game, wherein the drawing machine for jackpot game is used as the drawing machine, the drawing unit of the drawing machine for jackpot game starts the above drawing when a predetermined drawing start condition is satisfied by the progression of the game controlled by the game control unit of any one of the game machines, and the payout processing unit of the drawing machine for jackpot game executes a payout process for paying out an amount of payout-objects indicated by the payout amount data read from the storage unit to a player of the game machine which satisfies the predetermined drawing start condition when the drawing unit decides the winning in which any one of the plurality of types of jackpot prizes is awarded.

In the game system, it is possible to set a jackpot prize greater in the payout amount. However, on the other hand, where there is only one jackpot prize that can be awarded by the drawing, such a case of a drawing machine for jackpot game composed of a conventional game system, if other players win a jackpot prize, there is a great reducing in the desire for winning the jackpot prize and the game attractiveness is more likely to reduce.

According to the present game machine, as described above, even after one jackpot prize is awarded, a player experiences a strong desire to win other jackpot prizes. Therefore, the game attractiveness is not reduced at al, on the contrary the game attractiveness can be further enhanced. This is quite beneficial to a game system that is able to set a jackpot prize greater in payout amount.

Effect of the Invention

According to the present invention, even if one player wins a jackpot prize, the game attractiveness is not only prevented from reducing but also the game attractiveness can be enhanced.

DESCRIPTION OF REFERENCE NUMERALS

1: Pusher game machine
500: Play field
501: Main table
510: Pusher unit
600, 610, 620: Control units
2000: Center drawing device
2100: Rotational transfer device
2300: Display device
2400: Large drawing ball
2500: Large-ball-inserting-mechanism
2510: Ball collecting port
2520: Ball retaining part
2600: Transfer slope
B1, B2: Balls
JP1, JP2: Jackpot prizes
CP: Chance pocket prize
F: Retention space
M: Token
SA: Satellite unit
ST: Station unit

BEST MODE FOR CARRYING OUT THE INVENTION

Hereinafter, a description is given of one embodiment in which the present invention is applied to a pusher game machine being a token-operated game machine, with reference to the drawings. In addition, each of the drawings merely shows the shape, dimensions and positional relationship briefly to such an extent that is helpful in understanding the content of the present invention. The present invention shall not be therefore limited only to the shape, dimensions or positional relationship shown in each of the drawings. Further, in each of the drawings, in order to make a constitution clear, part of the hatching on the cross section is omitted. Still further, a numerical value to be exemplified later is only a preferable example of the present invention, and therefore the present invention shall not be limited to the exemplified numerical value.

(Entire Constitution)

Figure 3:
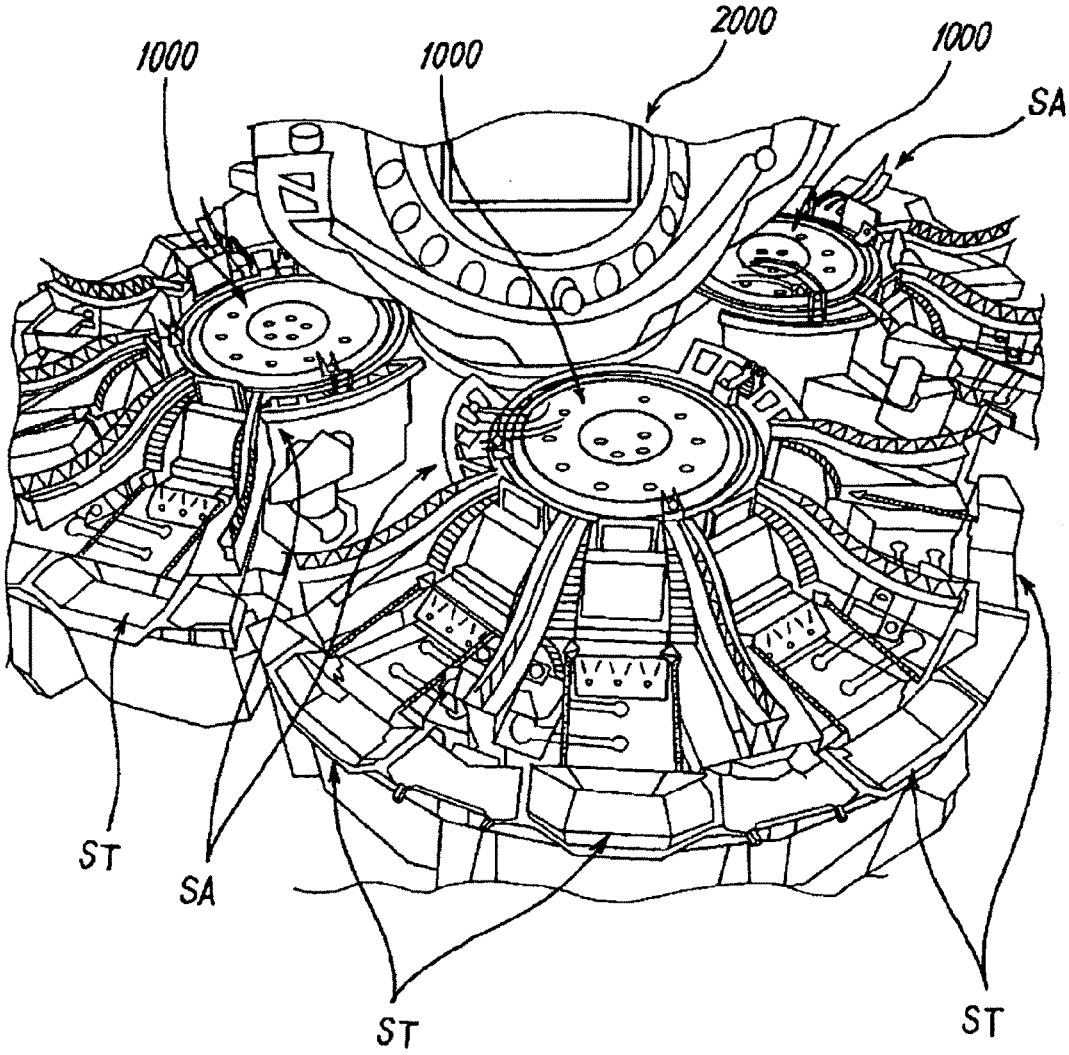
FIG. 3 is a partial perspective view showing an entire constitution of the pusher game machine.

FIG. 3 is a partial perspective view showing an entire constitution of a pusher game machine 1 according to the present embodiment.

The pusher game machine 1 is provided with four satellite units SA so as to surround a center drawing device 2000. Each of the satellite units SA is provided with four station units ST so that each player can play at the respective station units ST. Further, each of the satellite units SA is provided with one satellite drawing device 1000, and the respective station units ST are arranged in juxtaposition around the satellite drawing device 1000.

(Constitution of Station Unit)

Figure 4:
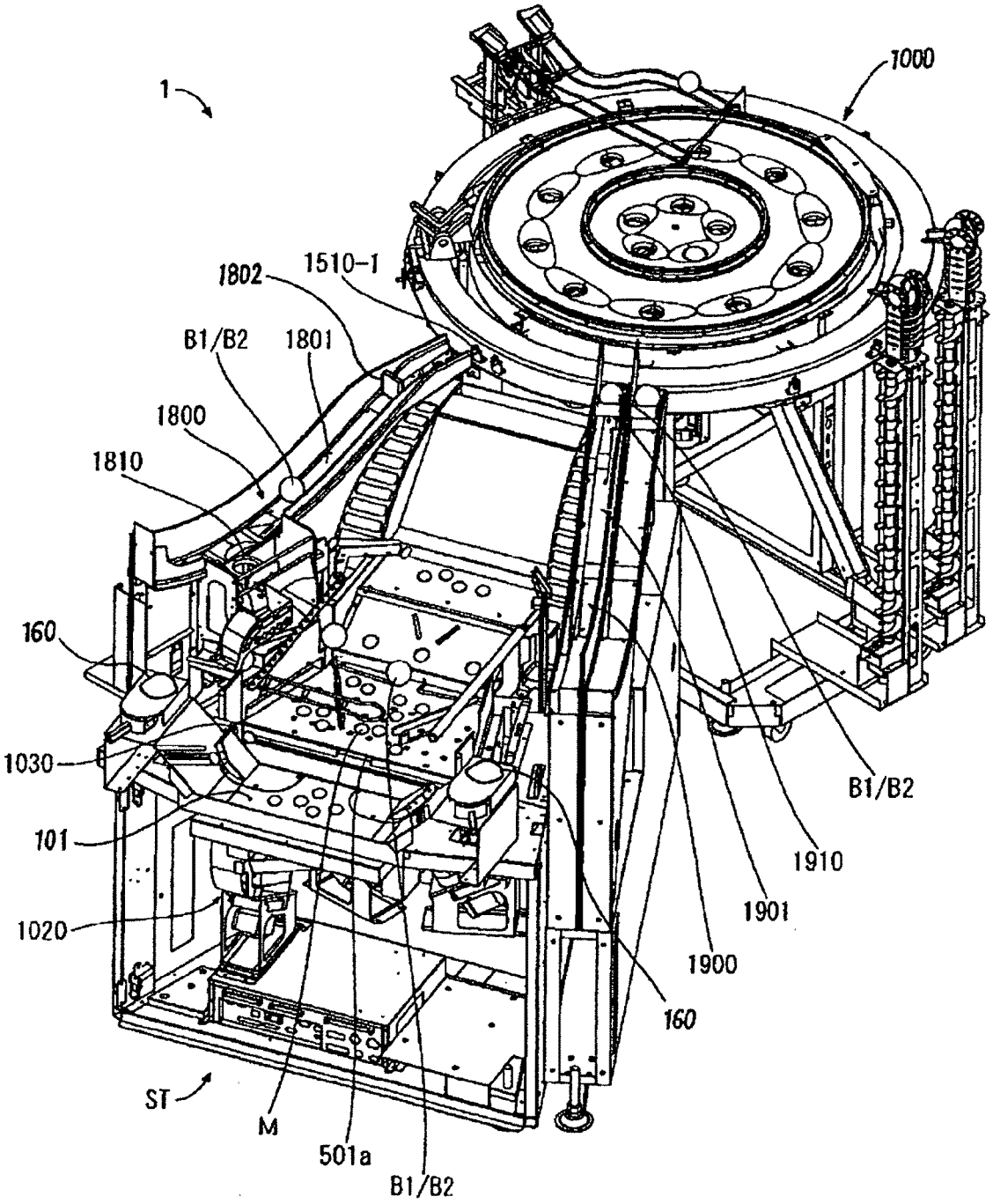
FIG. 4 is an explanatory view for explaining a constitution of a station unit in the pusher game machine.

FIG. 4 is an explanatory view for explaining a constitution of the station unit ST in the pusher game machine 1.

Figure 5:
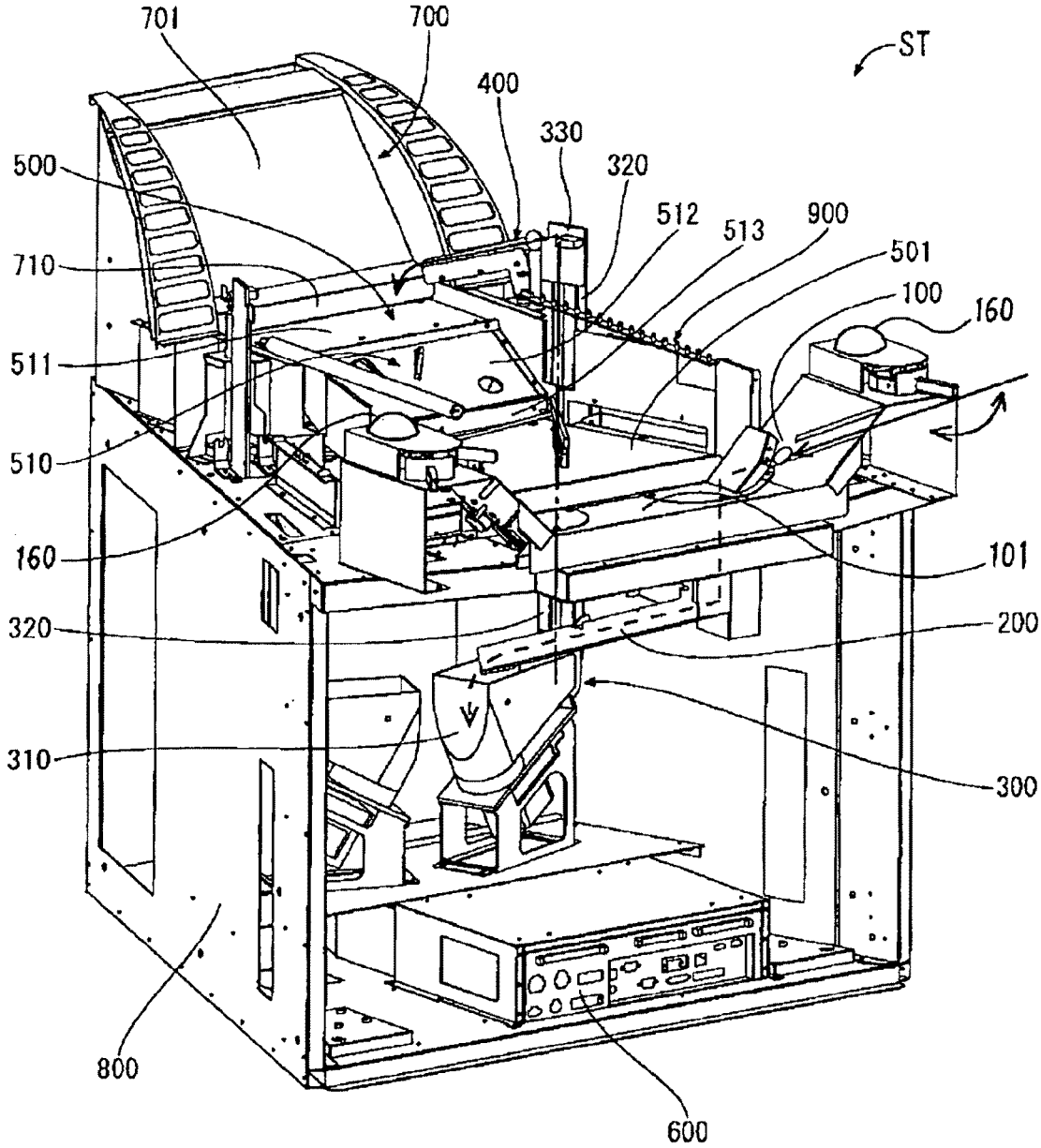
FIG. 5 is an explanatory view for explaining an internal structure of the station unit.

FIG. 5 is an explanatory view for explaining an internal structure of the station unit ST.

As shown in FIG. 5, the station unit ST includes a token inserting mechanism (inserting unit) 100, a token transfer channel 200, a lift-up hopper 300, token discharge channel 400, a play field 500, a control unit 600, a display unit 700, and a cabinet 800. In the present embodiment, a token sending-out unit functioning as token sending-out means is mainly composed of the token inserting mechanism (inserting unit) 100, the token transfer channel 200, the lift-up hopper 300 and the token discharge channel 400.

The cabinet 800 has a constitution that forms a framework of the station unit ST. In the cabinet 800, the token inserting mechanism 100 is arranged on the upper front side, and the display unit 700 as display means is arranged on the upper back side, and the play field 500 is arranged at the upper center. Further, the token transfer channel 200, the lift-up hopper 300, the control unit 600 and others are accommodated inside the cabinet 800. Herein, "front side" means a side at which a player is positioned during a game, "back side" means a side opposite to the side at which a player is positioned during a game, and "center" means a region between the above-described "front side" and "back side."

The token inserting mechanism 100 has a constitution in which a player inserts tokens M into the pusher game machine 1 during a game. The tokens M inserted from the token inserting mechanism 100 are transferred via the token transfer channel 200 to the lift-up hopper 300 and stored temporarily at the lift-up hopper 300. The token transfer channel 200 and the lift-up hopper 300 are, as described above, arranged in the cabinet 800. In addition, the token transfer channel 200 has functions to mechanically and physically connect the token inserting mechanism 100 and the lift-up hopper 300, and to transfer the tokens M inserted from the token inserting mechanism 100 to the lift-up hopper 300.

The lift-up hopper 300 includes a token storing unit 310 for storing tokens M, a lift-up unit 320 for lifting up the tokens M to a predetermined height, and a token discharge unit (discharge unit) 330 for discharging the thus lifted up tokens M at a predetermined timing. Further, a token discharge channel 400 for guiding the thus discharged tokens M to the play field 500 is provided with a discharge port of the token discharge unit 330 so as to sway in the lateral direction.

The upper end of the lift-up unit 320 is arranged above the play field 500. Accordingly the token discharge unit 330 provided with the upper end of the lift-up unit 320 is also arranged above the play field 500. As a result, the tokens M temporarily stored at the token storing unit 310 arranged below the play field 500 are lifted up above the play field 500 by the lift-up unit 320, and thereafter discharged from the token discharge unit 330 via the token discharge channel 400 into the play field 500.

A main table 501 as a token placed base for storing tokens M in a valid state and a pusher unit 510 as a token pushing-out member placed on the main table 501 are arranged inside the play field 500. In addition, the valid state means a state that is involved in the game. The pusher unit 510 includes an upper face for storing the tokens M in a valid state (which is referred to as a sub-table 511), an sloping table 512 on which the tokens M dropped from the sub-table 511 slide, and a pushing wall 513 for pushing the tokens M stored on the main table 501. Further, the pusher unit 510 is arranged on the main table 501 in the play field 500 so as to slide, and moves back and forth in a sliding manner at a constant cycle or any given cycle. Part (a back side) of the pusher unit 510 is accommodated in an accommodating unit 720 to be described later, which is arranged below the display unit 700. The pusher unit 510 slides in such a manner as to enter into and leave from the accommodating unit 720, thereby reciprocates back and forth.

A frame member 710 of a display 701 in the display unit 700 is in contact with the sub-table 511 so as to slide thereon. Therefore, where the pusher unit 510 moves to a direction at which it is accommodated into the accommodating unit 720, tokens M on the sub-table 511 are pushed by the frame member 710. This push allows part of the tokens M on the sub-table 511 to drop on the sloping table 512. Part of the tokens M dropped from the sub-table 511 enters into openings (which are referred to as chuckers 515-1, 515-2 and 515-3) as a token passage opening arranged on the sloping table 512. Further, remaining tokens M are dropped to the main table 501, as they are, and stored on the main table 501.

The tokens M on the main table 501 are pushed by a sliding movement of the pusher unit 510 in the same way as the tokens M on the sub-table 511. In other words, since the pusher unit 510 is placed on the main table 501 without any clearance, upon movement of the pusher unit 510 to a direction at which it moves out from the accommodating unit 720, the tokens M on the main table 501 are pushed by the pushing wall 513 that is the front face of the pusher unit 510. This push allows part of the tokens M on the main table 501 to drop. Of the thus dropped tokens M, the tokens M dropped from the end on the side of a player (which is referred to as a front end 501*a* (refer to FIG. 4)) into a token dropping groove are paid out to the player, whereas other tokens M, for example, tokens M dropped from either side of the main table 501 (which are referred to as a side end 501*b*) are stocked at a predetermined storing unit in the station unit ST.

In addition to the above-described constitution, as shown in FIG. 5, the station unit ST according to the present embodiment is also provided with a token-movement-quasi-performing-unit 900. The token-movement-quasi-performing-unit 900 is, as described later, provided with a plurality of light emitting units (LEDs 920 to be described later) arrayed from the vicinity of the token inserting mechanism 100 to the vicinity of the token discharge unit 330. These light emitting units are lit sequentially from a side of the token inserting mechanism 100 toward the token discharge unit 330, by which a movement scene of the tokens M inserted into the token inserting mechanism 100 is performed in a simulated manner. In this instance, it is acceptable that a channel through which the tokens M actually move may not be the same as or in close proximity to a channel simulated by the performance.

Further, the tokens M inserted from the token inserting mechanism 100 are temporarily stocked at the token storing unit 310 in the lift-up hopper 300. The tokens M stocked at the token storing unit 310 are lifted up by the lift-up unit 320 and preset at the token discharge unit 330 of the lift-up hopper 300. When the tokens M are inserted into the token inserting mechanism 100, the lift-up hopper 300 discharges into the play field 500 the tokens M preset at the token discharge unit 330 in accordance with control from the control unit 600. As described above, in the present embodiment, the tokens M inserted from a player are different from the tokens M actually inserted into the play field 500.

Still further, when tokens M are inserted into the token inserting mechanism 100, the token-movement-quasi-performing-unit 900 sequentially lights the arrayed LEDs 920 from the side of the token inserting mechanism 100 toward the token discharge unit 330 in accordance with control from the control unit 600. In this instance, if a timing at which the LED 920 in the vicinity of the token discharge unit 330 is lit and a timing at which the token M is discharged from the token discharge unit 330 are controlled, by which a movement scene of the tokens M inserted into the token inserting mechanism 100 can be performed in a simulated manner by the token-movement-quasi-performing-unit 900.

In addition, as shown in FIG. 4, the station unit ST is provided with a ball inserting mechanism 1800 at least on either side. The ball inserting mechanism 1800 has a constitution for inserting into the play field 500 a ball B1 or B2 that are spherical objects as foreign shape objects to be described later. The ball inserting mechanism 1800 is provided with a ball inserting slope 1801 and a ball-inserting-position-drawing-mechanism 1810. In addition, the balls B1 and B2 are drawing objects for carrying out a bingo game to be described later.

The ball inserting slope 1801 has a constitution for guiding the ball B1 or B2 inserted from a ball carrier 1520 to be described later to the ball-inserting-position-drawing-mechanism 1810 by a gravitational effect. It is therefore a declining slope. Further, the ball-inserting-position-drawing-mechanism 1810 has a constitution for by drawing a position on the play field 500 into which the ball B1 or B2 are inserted. As described above, the ball B1 or B2 which have been transferred from the ball carrier 1520 to be described later to the station unit ST are inserted into the play field 500 via the ball inserting slope 1801 and the ball-inserting-position-drawing-mechanism 1810.

Further, as shown in FIG. 4, the station unit ST is provided with a ball conveying mechanism 1900 at least on either side. The ball conveying mechanism 1900 has a constitution for conveying the ball B1 or B2 to the satellite drawing device 1000 when the ball B1 or B2 falls from the main table 501 in the play field 500 into the token dropping groove arranged on the front side thereof. The ball conveying mechanism 1900 is provided with a ball transfer channel 1040 and a ball conveying unit 1910 and a ball-conveying-unit-running-slope 1901 to be described later. The ball transfer channel 1040 is arranged below the front end 501*a*, thereby guiding the ball B1 or B2 fallen from the front end 501*a* to the ball conveying unit 1910. The ball conveying unit 1910 has a constitution for conveying the ball B1 or B2 received via the ball transfer channel 1040 to the satellite drawing device 1000. The ball conveying unit 1910 runs on the ball-conveying-unit-running-slope 1901 in accordance with control of the control unit 600. In addition, the ball B1 or B2 conveyed to the satellite drawing device 1000 is delivered to the ball carrier 1520 to be described later (refer to FIG. 8).

Still further, as shown in FIG. 4, the station unit ST is provided with a token payout mechanism including a lift-up hopper 1020 and a token payout unit 1030. Driving the token payout mechanism, tokens M as many as the tokens M dropped from the front end 501*a* to the token dropping groove are discharged into a storing portion 101 of the token inserting mechanism 100.

Figure 6:
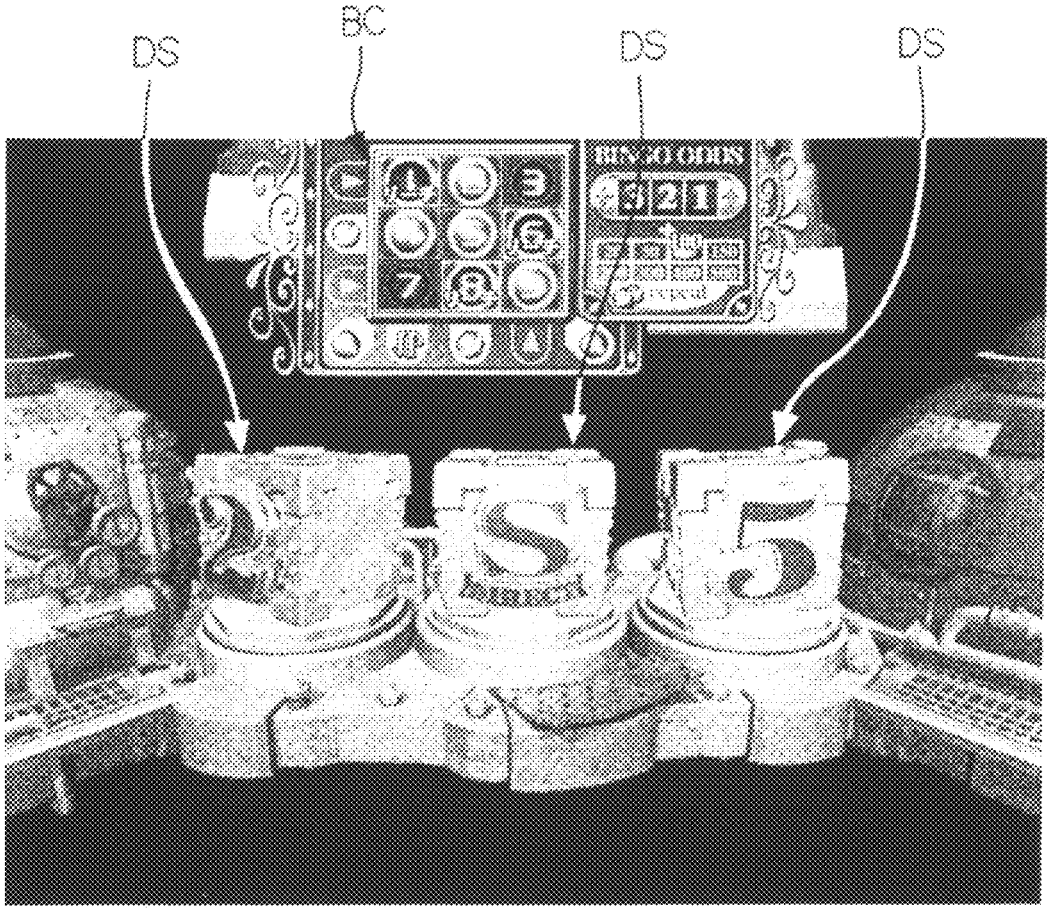
FIG. 6 is an explanatory view showing one example of a slot game screen displayed on a display unit of the station unit.
Figure 7:
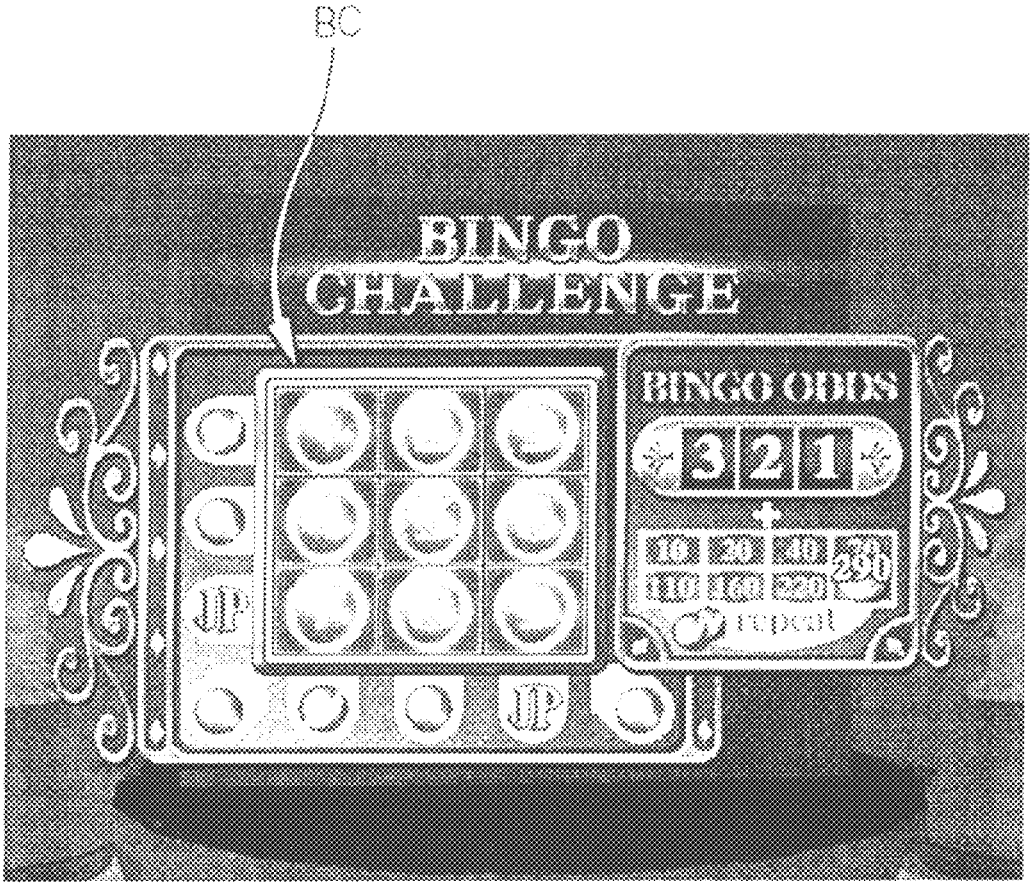
FIG. 7 is an explanatory view showing one example of a bingo game screen displayed on the display unit of the station unit.

In addition, a game screen of games such as a bingo game and a digital drawing game (slot game) different from the pusher game is displayed on the display unit 700 at the station unit ST. In the present pusher game machine 1, as will be described later, besides the pusher game, a slot game screen shown in FIG. 6 is displayed on the display unit 700 and the slot game is carried out. Also, a bingo game screen shown in FIG. 7 is displayed on the display unit 700 and the bingo game is carried out.

The slot game is a digital drawing game in which the control unit 600 at the station unit ST mainly carries out a drawing digitally. This slot game is started under the condition that the token M enters into any one of chuckers 515-1, 515-2 and 515-3 arranged on the sloping table 512 at the pusher unit 510. The slot game screen shown in FIG. 6 is displayed on the display unit 700 during a period when the bingo game to be described later does not progress. When the token M enters into any one of the chuckers 515-1, 515-2, 515-3 and thereby the slot drawing start condition is satisfied, the control unit 600 controls to display for rotating three dice-shaped slots DS. In the digital drawing of the slot game, the control unit 600 executes a predetermined drawing program and decides whether a winning that any one of specific-combinations is awarded or a non-winning by referring to a predetermined winning table based on generated random number. Thereafter, where a winning combination is decided, the control unit 600 controls to display for allowing the display unit 700 to halt the rotation of the three dice-shaped slots DS so as to halt and display a pattern of symbols related to the winning combination.

In the present embodiment, as the specific-combinations of the digital drawing, provided are a minor-combination A in which three tokens are supplied to the play field 500, a minor-combination B in which eight tokens are supplied to the play field 500, a ball supply combination in which the ball B1 is supplied to the play field 500, an normal bonus combination in which thirty tokens are supplied to the play field 500, a probability-change bonus combination in which thirty tokens are supplied to the play field 500 and a winning table at which a winning probability is set to be higher is used in subsequent digital drawings, a direct satellite combination in which the ball B1 is directly supplied to the satellite drawing device 1000, a direct center combination in which the ball B1 is directly supplied to the center drawing device 2000, and others. The winning probability of each of these combinations is set to be reduced in accordance with the above-described order. In addition, which specific-combination is provided or to which winning probability each of the specific-combinations is set is determined arbitrarily. For example, various benefits such as direct payment of tokens M are given to a player.

In the present embodiment, the control unit 600, which is a supply drawing unit, functions as supply drawing means, decides whether a ball supply combination is awarded or not, thereby carrying out a drawing whether the ball B1 is supplied to the play field 500 or not. Then, when the ball supply combination is awarded by the digital drawing of the control unit 600, the control unit 600 outputs a ball supply order to a control unit (not illustrated) of the satellite drawing device 1000. Thereby, the control unit of the satellite drawing device 1000 delivers, as will be described later, the ball B1 from a ball supply mechanism 1300 to the ball carrier 1520, by which the ball carrier 1520 is moved along the outer circumference of an annular ball transfer channel 1500 to a corresponding position of the station unit ST at which the ball supply combination is awarded. After that, the ball B1 is delivered from the ball carrier 1520 to the ball inserting mechanism 1800 of the station unit ST, and the ball B1 is supplied from the ball inserting mechanism 1800 to the play field 500. In addition, in the present embodiment, the ball B2 is supplied to the play field 500 only when BINGO of a specific line on a bingo card is established in the bingo game to be described later. A constitution and movements related to thus ball supply are substantially similar to those of the ball B1 excluding the fact that the ball B2 is delivered from a ball supply mechanism 1400 different from the ball supply mechanism 1300 to the ball carrier 1520.

In the present embodiment, as described above, a constitution for supplying the ball B1 or B2 to the play field 500 composed of a foreign-shape-object-supplying-unit which functions as foreign-shape-object-supplying-means.

The bingo game is a physical drawing game which is progressed by a physical drawing using two types of balls B1, B2 and the satellite drawing device 1000. The bingo game is allowed to progress by a control unit (not illustrated) of the satellite drawing device 1000 to be described later and the control unit 600 of the station unit ST. In addition, in the bingo game, the control unit of the satellite drawing device 1000 mainly controls a drawing for deciding the winning bingo numbers of the bingo game. The control unit 600 of each of the station units ST belonging to the satellite unit SA including the satellite drawing device 1000 is mainly in charge of controlling the performance of the bingo game and the judgment of the establishment of BINGO. In the present embodiment, the ball B1 or B2 is moved by the satellite drawing device 1000, by which such a physical drawing is carried out that one winning bingo number (a winning object) is selected from a plurality of mutually different bingo numbers (drawing objects). In the physical drawing of the present embodiment, one winning bingo number is selected from the bingo numbers of "1" through "9." Then, pattern information of the bingo card at which these bingo numbers of "1" through "9" are arrayed in a matrix form is generated individually for each of the station units ST by the control unit 600 as a pattern-information generating unit which functions as pattern-information generating means for the station unit ST. Thereafter, a bingo card image BC in which images of the bingo numbers of "1" to "9" (drawing object images) are arrayed according to the pattern information is, as shown in FIG. 7, displayed on the display unit 700 of each of the station units ST. In the present embodiment, while the bingo game does not progress, the slot game screen shown in FIG. 6 is displayed on the display unit 700, and when a physical drawing of the bingo game is started, it is changed to the bingo game screen shown in FIG. 7. In addition, on completion of the physical drawing of the bingo game, the screen is again returned to the slot game screen. However, the bingo card image BC is displayed to be small at the upper part on the slot game screen as shown in FIG. 6. Therefore, a player is able to constantly confirm how many winning bingo numbers are obtained on the bingo card of the station unit ST that a player plays.

In the present embodiment, each of the bingo games carried out at each station is usually executed independently for each station unit ST. In other words, where the ball B1 or B2 falls on the token dropping groove at one station unit ST to start the physical drawing in the satellite drawing device 1000, a bingo number that is drawn thereby is handled as a winning bingo number only at the one station unit ST and not handled as a winning bingo number at other station units ST. However, in the present embodiment, where a predetermined event condition to be described later is satisfied, a bingo number which is drawn by the physical drawing carried out when the ball B1 or B2 falls on the token dropping groove of one station unit ST is handled as a winning bingo number not only at the one station unit ST but also at other station units ST as well.

In this instance, these other station units ST in the present embodiment are three remaining station units ST belonging to the satellite unit SA to which the above one station unit ST also belongs. In other words, in the present embodiment, all the station units ST provided in the present pusher game machine 1 are divided into a plurality of groups, each of which is given as the satellite unit SA, and the above event condition is satisfied between the station units ST belonging to the satellite unit SA, thereby developing a state that the game of each player is mutually related. As a result, a game attractiveness, for example, that players who play at station units ST belonging to the same satellite unit SA cooperate with each other to obtain tokens is created.

Other details of the bingo game according to the present embodiment will be described later.

(Constitution of Satellite Drawing Device)

Figure 8:
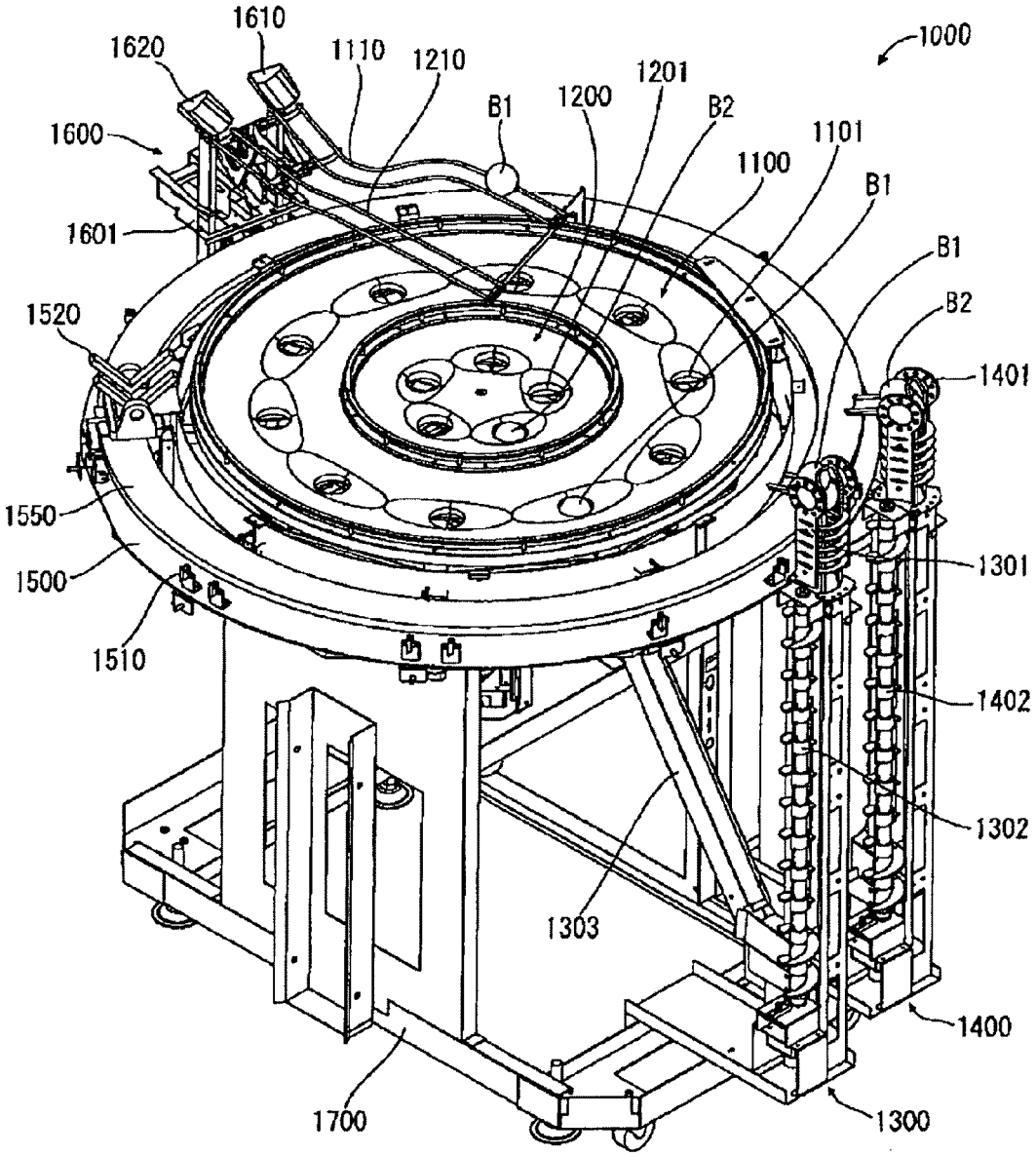
FIG. 8 is a perspective view showing a major constitution of a satellite drawing device in the pusher game machine.

FIG. 8 is a perspective view showing a major constitution of the satellite drawing device 1000.

The satellite drawing device 1000 includes an outer bingo stage 1100, an inner bingo stage 1200, the ball supply mechanisms 1300 and 1400, the ball transfer channel 1500, a stage-ball-inserting-mechanism 1600 and a supporting base 1700.

The supporting base 1700 has a constitution acting as a framework of the satellite drawing device 1000, and supporting other constitutions thereof. The inner bingo stage 1200 is arranged at the upper center of the supporting base 1700. The outer bingo stage 1100 is arranged so as to surround the inner bingo stage 1200. Further, the ball transfer channel 1500 is arranged so as to surround the outer bingo stage 1100. The ball supply mechanisms 1300 and 1400 are arranged at the side of the ball transfer channel 1500.

The ball supply mechanism 1300 has a constitution for supplying a certain type of ball, for example, a non-metal ball B1. On the other hand, the ball supply mechanism 1400 has a constitution for supplying a type of ball different from the ball B1, for example, a metal ball B2. In addition, a difference between the ball B1 and the ball B2 may be defined by other factors, for example, the color of the ball, not depending on whether it is a metal ball or a non-metal ball.

The ball supply mechanism 1300 includes a ball supply unit 1301, a lift-up unit 1302, and a ball returning channel 1303. The ball supply unit 1301 has a constitution for supplying the ball B1 to the ball carrier 1520 to be described later. The lift-up unit 1302 has a constitution for lifting up the ball B1 up to the ball supply unit 1301. The ball returning channel 1303 has a constitution acting as a channel for returning the ball B1 supplied to the outer bingo stage 1100 to be described later to the lift-up unit 1302 in the ball supply mechanism 1300.

Similarly, the ball supply mechanism 1400 includes a ball supply unit 1401, a lift-up unit 1402 and a ball returning channel (not illustrated). The ball supply unit 1401 has a constitution for supplying the ball B2 to the ball carrier 1520 to be described later. The lift-up unit 1402 has a constitution for lifting up the ball B2 to the ball supply unit 1401. The ball returning channel (not illustrated) has a constitution acting as a channel for returning the ball B2 supplied to the inner bingo stage 1200 to be described later to the lift-up unit 1402 in the second ball supply mechanism 1400.

The ball carrier 1520 has a constitution for conveying the ball B1 or B2 along the outer circumference of the annular ball transfer channel 1500. The ball carrier 1520 is provided with a receiving unit composed of two bar-like members bent in a V letter shape, by which the ball B1 or B2 are retained. Further, the ball carrier 1520 is fixed to a ring-shaped member 1550 arranged along the ball transfer channel 1500. Therefore, the ring-shaped member is rotated along the ball transfer channel 1500, by which the ball carrier 1520 moves along the ball transfer channel 1500.

The ball transfer channel 1500 is provided on the outer circumferential face with a plurality of sensor units 1510. The sensor units 1510 has a constitution for detecting whether the ball carriers 1520 are present in the closest vicinity thereof. Information detected by the sensor units 1510 is input, for example, into a control unit (not illustrated) whenever necessary or on real time basis. This control unit specifies a position of the ball carrier 1520 on the basis of information sent from the sensor units 1510, thereby controls the running and halt of the ball carrier 1520. For example, where the ball B1 is supplied to the station unit ST shown in FIG. 4, this control unit allows the ball carrier 1520 to halt at a position of the sensor unit 1510-1 on the basis of information from the sensor units 1510. Thereby, the ball carrier 1520 is positioned on an extension of the ball inserting slope 1801. In this state, when the V letter shaped receiving unit of the ball carrier 1520 is tilted toward the ball inserting slope 1801 by using the control unit (not illustrated), the ball B1 or B2 retained on the ball carrier 1520 are inserted into an inlet of the ball inserting slope 1801 (refer to FIG. 4). In addition, the sensor units 1510 are arranged on the outer circumferential face of the ball transfer channel 1500 and respectively at a position where the ball inserting slope 1801 at individual station units ST is arranged and a position where the ball-conveying-unit-running-slope 1901 is arranged.

The ball B1 or B2 inserted into the ball inserting slope 1801 is temporarily retained by a stopper 1802 shown in FIG. 4. Then, when a player pushes a button 160 and thereby a button operating signal is sent to the control unit 600, the control unit 600 controls for driving the stopper 1802 so as to tilt toward an outlet of the ball inserting slope 1801. Thereby, the ball B1 or B2 retained by the stopper 1802 rolls down due to inclination of the ball inserting slope 1801, and is inserted into the play field 500 via the ball-inserting-position-drawing-mechanism 1810. The ball B1 or B2 which has been inserted into the play field 500 falls, in the same way as tokens M, from the front end 501*a* of the main table 501 to the token dropping groove while the pusher game progresses. The fallen ball B1 or B2 is, as described above, set at the ball conveying unit 1910 via the ball transfer channel 1040 to be described later. In addition, the ball transfer channel 1040 is provided with a ball receiving unit 1041 for receiving only the ball B1 or B2 and allowing the tokens M to pass. Also, the ball conveying unit 1910 is normally on standby at a ball discharge port 1043 of the ball transfer channel 1040.

As described above, the ball conveying unit 1910 has a constitution for conveying the ball B1 or B2 to the satellite drawing device 1000. When the ball B1 or B2 is set, the ball conveying unit 1910 runs up the ball-conveying-unit-running-slope 1901 on the basis of controlling from the control unit (not illustrated), and moves up to the upper end of the ball-conveying unit traveling slope 1901. The ball carrier 1520 is on standby in the vicinity of the upper end of the ball-conveying-unit-running-slope 1901. After the ball conveying unit 1910 has moved to the upper end of the ball-conveying-unit-running-slope 1901, the ball conveying unit 1910 delivers the transferred ball B1 or B2 to the ball carrier 1520. In addition, the ball carrier 1520 to which the ball B1 or B2 has been delivered is in a posture of retaining this.

Further, upon receipt of the ball B1 or B2, the ball carrier 1520 moves to a position facing the stage-ball-inserting-mechanism 1600 on the basis of control from the control unit (not illustrated). The stage-ball-inserting-mechanism 1600 includes a catch pan 1610 for inserting the ball B1 into the outer bingo stage 1100 and a catch pan 1620 for inserting the ball B2 into the inner bingo stage 1200. The ball carrier 1520 moves to a position facing the catch pan 1610 or 1620 depending on a type of the balls (B1, B2) that is retained, on the basis of control from the above-described control unit (not illustrated). Where the catch pan 1610 or 1620 receives the ball from the ball carrier 1520, the catch pan 1610 or 1620 moves down to a position facing the ball carrier 1520. After receipt of the ball from the ball carrier 1520, the catch pan 1610 or 1620 moves up to a position facing the ball inserting channel 1110 or 1210. Then, the catch pan 1610 or 1620 retains the ball until a ball inserting timing.

For example, where the ball B1 is received from the ball conveying unit 1910, the ball carrier 1520 runs along the ball transfer channel 1500 and thereafter delivers the ball B1 to the catch pan 1610 in the stage-ball-inserting-mechanism 1600. The catch pan 1610, which has received the ball B1, inserts the retaining ball B1 into the ball inserting channel 1110, for example, at a timing when a player pushes the button 160. The thus inserted ball B1 is accelerated according to the inclination and length of the ball inserting channel 1110 and thereafter inserted into the outer bingo stage 1100. Further, for example, where the ball B2 is received from the ball conveying unit 1910, the ball carrier 1520 runs along the ball transfer channel 1500 and thereafter delivers the ball B2 to the catch pan 1620 in the stage-ball-inserting-mechanism 1600. The catch pan 1620, which has received the ball B2, inserts the retaining ball B2 into the ball inserting channel 1210, for example, at a timing when a player pushes the button 160. The thus inserted ball B2 is accelerated according to the inclination and length of the ball inserting channel 1210 and thereafter inserted into the inner bingo stage 1200. In addition, whether a type of the ball delivered to the ball carrier 1520 is the B1 or B2 can be detected by mounting a metal sensor on the ball carrier 1520, for example, where the ball B1 is made of a non-metal material and the ball B2 is made of a metal. Further, for example, where a different color is given to the ball B1 and the ball B2, a color sensor or the like is mounted on the ball carrier 1520, thus making it possible to detect a type of the ball. Also, information on the type of the thus detected ball is sent to a control unit (not illustrated). Therefore, the ball carrier 1520 is controlled on the basis of the type of the ball notified to the control unit.

The outer bingo stage 1100 is provided with two or more holes (which are referred to as winning spots 1101) having such a diameter that allows the ball B1 to pass. The outer bingo stage 1100 is rotating around the inner bingo stage 1200 in a predetermined cycle. In the present embodiment, there are a total of ten winning spots 1101 to which bingo numbers of "1" through "9" used in the bingo game and a right for starting a drawing at the center drawing device 2000 are individually allocated. The ball B1 that has been inserted into the outer bingo stage 1100 goes around in the outer bingo stage 1100 by acceleration obtained at the ball inserting channel 1110 and the rotation of the outer bingo stage 1100 itself, and thereafter enters into any one of the winning spots 1101. Information on which of the winning spots 1101 the ball B1 has entered is sent to a control unit (not illustrated) appropriately. When the ball B1 enters into any one of the winning spots 1101 to which bingo numbers are allocated, this control unit decides a bingo number allocated to the winning spot 1101 as a winning bingo number in cooperation with the control unit 600 of the station unit ST from which the ball B1 is transferred, or the like, and progresses the bingo game. In addition, the ball B1 that has entered into the winning spot 1101 is retained temporarily at an inlet of the winning spot 1101 so as to be confirmed by a player and thereafter inserted into the ball returning channel 1303 arranged below the outer bingo stage 1100.

Similarly, the inner bingo stage 1200 is provided with one or more of winning spots 1201 having such a diameter that allows the ball B2 to pass. The inner bingo stage 1200 is rotating in a predetermined cycle around a central pivot thereof. In the present embodiment, there are four winning spots 1201 to which bingo numbers of "1" to "8" used in the bingo game are individually allocated by two each and one winning spot 1201 to which a right for starting the drawing at the center drawing device 2000 is allocated, a total of five winning spots 1201. The ball B2 that has been inserted into the inner bingo stage 1200 goes around in the inner bingo stage 1200 by acceleration obtained at the ball inserting channel 1210 and the rotation of the inner bingo stage 1200 itself, and thereafter enters into any one of the winning spots 1201. Information on which of the winning spots 1201 the ball B2 has entered is sent to the control unit (not illustrated) appropriately. When the ball B2 enters into any one of the winning spots 1201 to which bingo numbers are allocated, this control unit decides bingo numbers allocated to the winning spot 1101 as winning bingo numbers in cooperation with the control unit 600 of the station unit ST from which the ball B2 is transferred, or the like, and progresses the bingo game. In addition, the ball B2 that has entered into the winning spot 1201 is retained temporarily at an inlet of the winning spot 1201 so as to be confirmed by a player and thereafter inserted into a ball returning channel (not illustrated) arranged below the inner bingo stage 1200.

Further, when at the outer bingo stage 1100 or the inner bingo stage 1200, the ball B1 or B2 enters into the winning spots 1101 or 1201 to which the right for starting the drawing at the center drawing device 2000 is allocated, the control unit (not illustrated) of the satellite drawing device 1000 outputs an order for starting a jackpot game to a control unit (not illustrated) of the center drawing device 2000 to be described later. The details of the jackpot game at the center drawing device 2000 will be described later.

(Constitution of Play Field)

Figure 9:
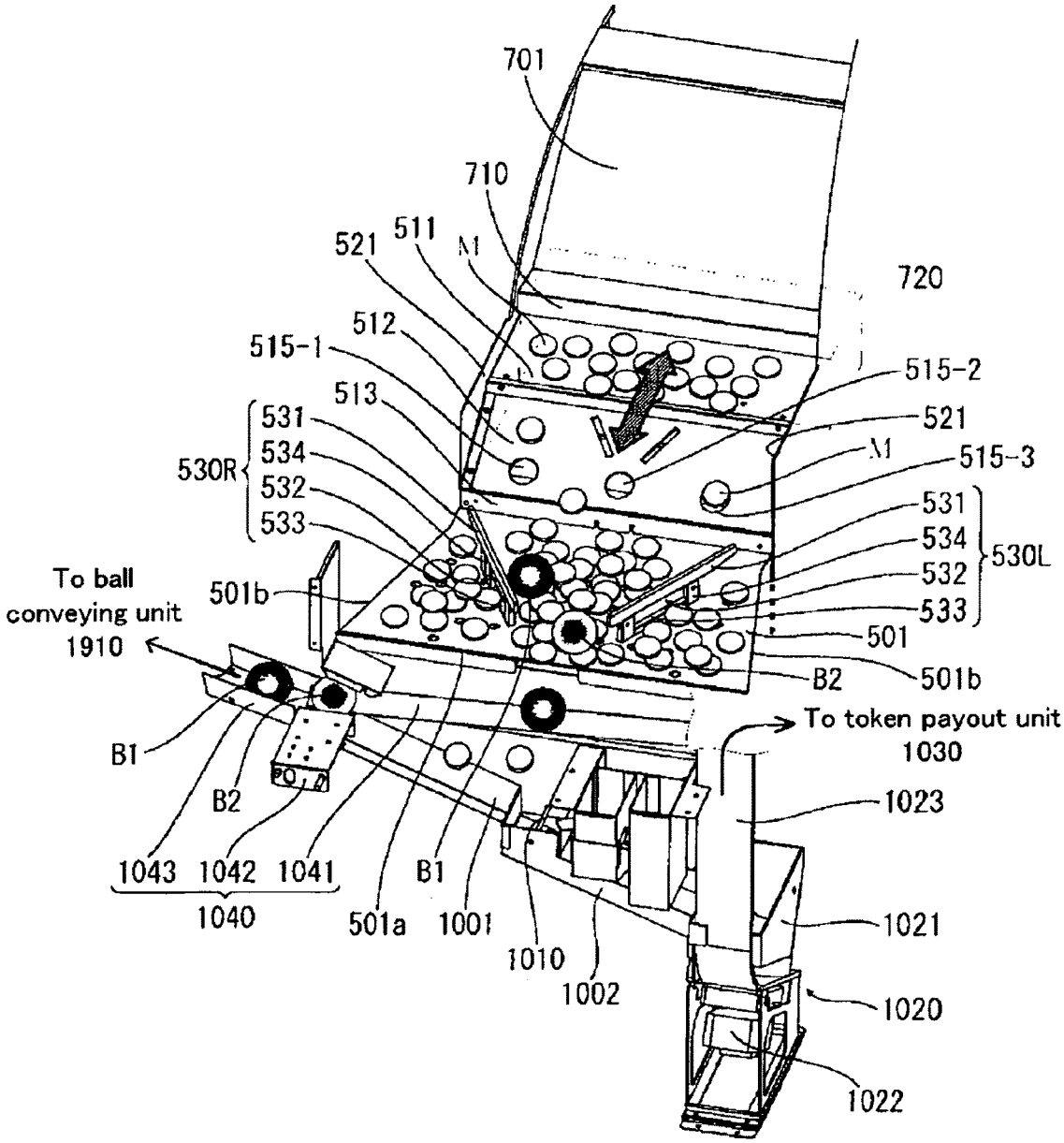
FIG. 9 is a partial perspective view in which a constitution of a play field of the station unit and a peripheral part thereof is extracted.

FIG. 9 is a partial perspective view in which a constitution of the play field 500 and the peripheral part thereof is extracted.

Figure 10A:
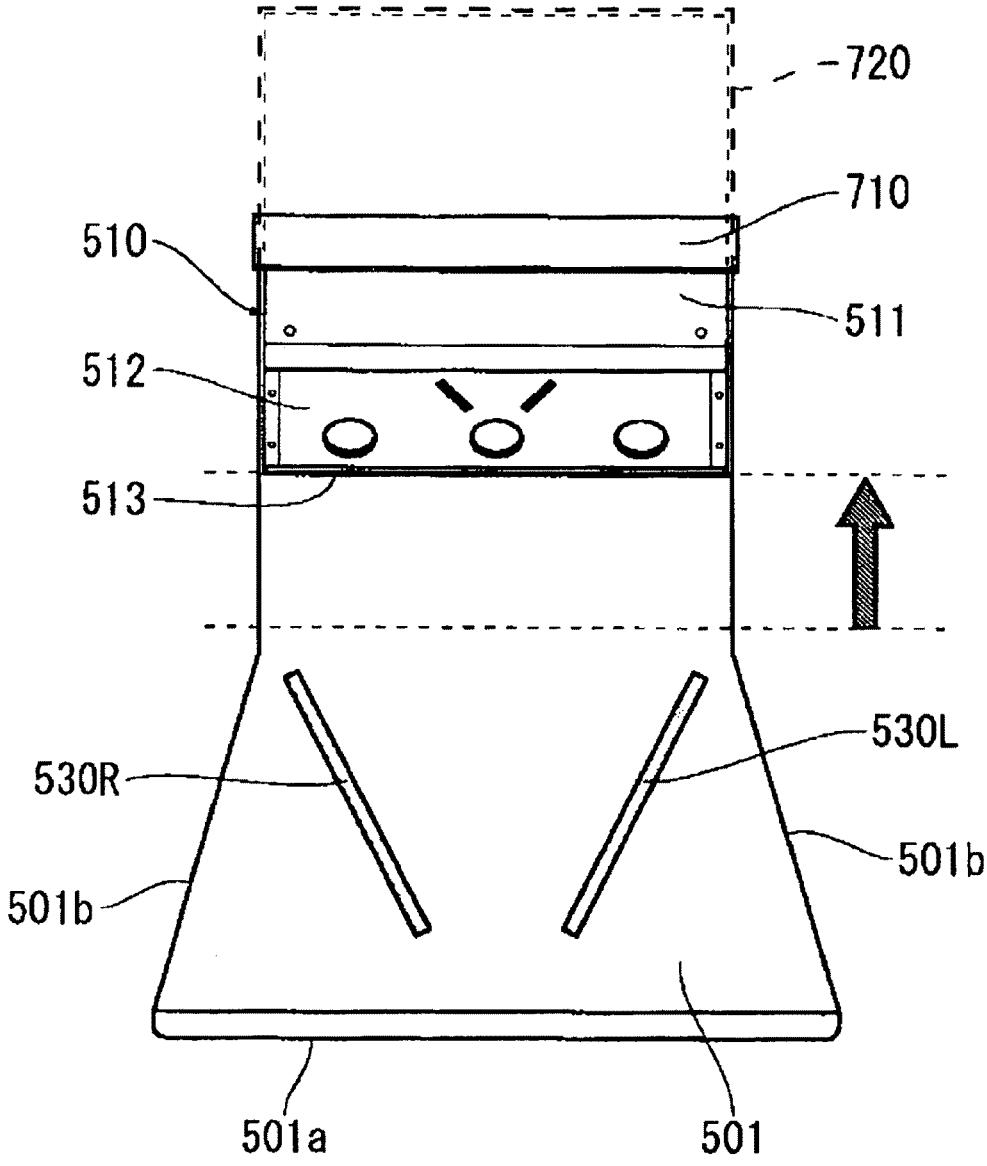
FIG. 10A is an explanatory view for explaining a reciprocating movement of a pusher unit in the play field.
Figure 10B:
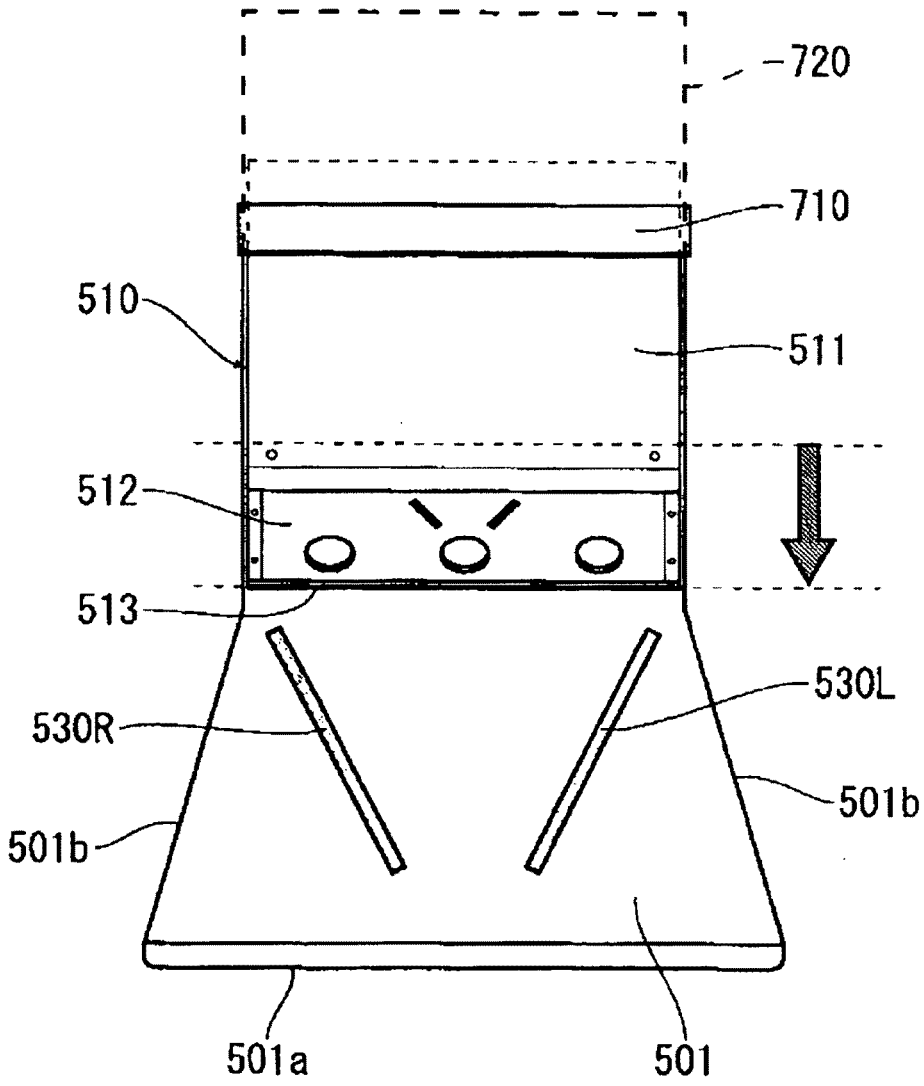
FIG. 10B is an explanatory view for explaining the reciprocating movement of the pusher unit in the play field.

FIG. 10A and FIG. 10B are explanatory view for explaining a reciprocating movement of the pusher unit 510 in the play field 500.

As described above, the play field 500 is composed of the main table 501 that is the token placed base, and the pusher unit 510 that is the token pushing-out member placed on the main table 501 so as to slide. The pusher unit 510 moves in a sliding manner back and forth on the main table 501 so as to enter into and leave from the accommodating unit 720 arranged below a display 701 of the display unit 700. In addition, FIG. 10A is an upper view taken when the pusher unit 510 retracts into the accommodating unit 720 to the greatest extent, whereas FIG. 10B is an upper view taken when the pusher unit 510 projects from the accommodating unit 720 to the greatest extent.

As described above, the frame member 710 of the display unit 700 is in contact with the sub-table 511, which is an upper face of the pusher unit 510. Therefore, tokens M stored on the sub-table 511, which is an upper face of the pusher unit 510, are pushed on the sub-table 511 by the frame member 710 toward the sloping table 512 when the pusher unit 510 moves to a direction at which it retracts into the accommodating unit 720 (refer to FIG. 10B→FIG. 10A), and thereby the tokens M on the sub-table 511 flow in a direction toward the sloping table 512 as a whole. As a result, part of the tokens M on the sub-table 511 in the vicinity of the sloping table 512 is dropped to the sloping table 512. In addition, of the thus dropped tokens M, part of the tokens M enters into any one of chuckers 515-1, 515-2 and 515-3 arranged on the sloping table 512, and the remaining of them are dropped on the main table 501. Further, a drop prevention wall 521 is provided on both sides covering a range at which the pusher unit 510 slides, thereby preventing the tokens M from dropping from the sides of the sub-table 511.

Further, the pusher unit 510 is placed on the main table 501 without any clearance. In addition, "without any clearance" referred to here means that there is no clearance, which is greater than the width of the token M. Therefore, the tokens M stored on the main table 501 are pushed by the pushing wall 513, which is the front face of the pusher unit 510, toward the front end 501*a* on the main table 501 when the pusher unit 510 moves to a direction at which it leaves from the accommodating unit 720 (refer to FIG. 10A→FIG. 10B) and the tokens M on the main table 501 flow in a direction toward the front end 501*a* as a whole. As a result, part of the tokens M on the main table 501 in the vicinity of the front end 501*a* is dropped into the token dropping groove from the front end 501*a*. Also, part of the tokens M on the main table 501 in the vicinity of the end (side end 501*b*) on both sides of the main table 501 may be dropped from the side end 501*b* by the flow of the tokens M. In addition, the tokens M dropped from the side end 501*b* are stored at a predetermined storing unit (a hopper is also acceptable) inside the station unit ST.

Still further, as shown in FIG. 9, the tokens M dropped from, the front end 501*a* are received on a token receiver 1001 arranged below the front end 501*a*, that is, inside the token dropping groove. The token receiver 1001 is connected to a token transfer channel 1002 for transferring the tokens M to the lift-up hopper 1020 in a token payout mechanism. Further, the token receiver 1001 is inclined toward a connecting part with the token transfer channel 1002. Therefore, the tokens M received on the token receiver 1001 flow into the token transfer channel 1002. The token transfer channel 1002 is also inclined toward a storing unit 1021 in the lift-up hopper 1020 of the token payout mechanism. Therefore, the tokens M that have flown into the token transfer channel 1002 are continuously led to the token payout mechanism. In addition, an assortment bar 1010 to be described later for stopping the ball B1 or B2 is arranged at the connecting part between the token receiver 1001 and the token transfer channel 1002, and by which the ball B1 or B2 does not enter into the token payout mechanism.

The token payout mechanism is provided with a token counter (not illustrated) for counting the number of tokens M, in addition to the above-described lift-up hopper 1020 and the token payout unit 1030. The token counter is arranged, for example, at an inlet of the storing unit 1021 in the lift-up hopper 1020, and counts the number of tokens M inserted from the token transfer channel 1002 to the storing unit 1021. The control unit 600 shown in FIG. 5 is notified of the number of the tokens M counted by the token counter. The control unit 600 drives the lift-up hopper 1020 on the basis of the thus notified number of the tokens, thereby the corresponding number of the tokens M is paid out from the token payout unit 1030 to the storing portion 101 in the token inserting mechanism 100. The lift-up hopper 1020 includes a hopper driving unit 1022 and a lift-up unit 1023. The hopper driving unit 1022 is driven on the basis of control from the control unit 600, thereby the tokens M are paid from the token payout unit 1030 arranged at the end of the lift-up unit 1023. In addition, the token payout mechanism, which is a payout unit including the token receiver 1001, the token transfer channel 1002, the lift-up hopper 1020, the token payout unit 1030 and the token counter, function as payout means for paying out to a player the tokens M dropped from the front end 501*a* of the main table 501 to the token dropping groove.

Further, the balls B1 and B2 supplied from the ball carrier 1520 of the satellite drawing device 1000 are also present on the main table 501. These balls B1 and B2 move on the main table 501 in association with a flow of the tokens M by the reciprocating movement of the pusher unit 510 and thereafter drop from the front end 501*a* into the token dropping groove. As described above, the ball transfer channel 1040 is arranged below the front end 501*a*, that is, inside the token dropping groove. The ball transfer channel 1040 includes the ball receiving unit 1041 which receives only the fallen ball B1 or B2 and allows the tokens M to pass, a ball halting unit 1042 which retains the ball received at the ball receiving unit 1041 until a predetermined condition is satisfied, and the ball discharge port 1043. Therefore, the ball B1 or B2 which has been received at the ball receiving unit 1041 is halted by the ball halting unit 1042 until a predetermined timing and thereafter discharged from the ball discharge port 1043. Thereby, the ball B1 or B2 is set to the ball conveying unit 1910 (refer to FIG. 4) kept on standby at the ball discharge port 1043. In addition, the position of the station unit ST shown in FIG. 4 and the station unit ST shown in FIG. 5 or FIG. 9 are reversed in the lateral direction for the convenience of explanation but similar in constitution.

Still further, as shown in FIG. 9, guide units 530R and 530L for controlling the flow of the tokens M and balls B1 and B2 are arranged on the main table 501. A guide-unit-moving-mechanism 540 for moving vertically the guide units 530R and 530L with respect to the main table 501 is also arranged below the main table 501. The guide units 530R and 530L are respectively provided with a ball guide plate 531 for controlling the flow of the balls B1 and B2, a token guide plate 533 for controlling the flow of the tokens M, and a support member 534 for supporting the ball guide plate 531 and the token guide plate 533. The ball guide plate 531 and the token guide plate 533 are also vertically supported by the support member 534 so as to make a passage opening 532 of predetermined configuration between the ball guide plate 531 and the token guide plate 533.

Where the guide units 530R and 530L are moved to a lower limit position, the upper end of the token guide plate 533 at the guide units 530R and 530L is located at the same level as the upper face of the main table 501 or below wherefrom. In other words, where the guide units 530R and 530L are moved to the lower limit position, the token guide plate 533 is accommodated below the main table 501. However, in this instance as well, the passage opening 532 in its entirety between the token guide plate 533 and the ball guide plate 531 is not closed. Therefore, in a state that the token guide plate 533 retracts below the main table 501, the flow of tokens M on the main table 501 is not prevented by the token guide plate 533, thereby the tokens M can pass through the passage opening 532 and flow in any arbitrary direction. In other words, the tokens M are able to flow to the side end 501*b* on the main table 501. As a result, the tokens M dropped from the side end 501*b* are available in a greater number, for example, than a case where the guide units 530R and 530L are moved to an upper limit position. The flow of tokens M is prevented by the support member 534, which will be, however, disregarded for simplifying the explanation. Further, even where the guide units 530R and 530L are moved to the lower limit position, the ball guide plate 531 projects above the main table 501, thereby a flow of the balls B1 and B2 is restricted by the ball guide plate 531. In other words, the balls B1 and B2 are guided to a direction of the front end 501*a* so as not to fall from the side end 501*b* of the main table 501.

On the other hand, where the guide units 530R and 530L are moved to the upper limit position, the upper end of the token guide plate 533 at the guide units 530R and 530L is projected above main table 501. In such a state, a flow of tokens M on the main table 501 is prevented by the token guide plate 533. Therefore, a direction at which the tokens M flow is restricted to a direction of the front end 501*a*. As a result, the tokens M dropped from the side end 501*b* can be made smaller in number, for example, than a case where the guide units 530R and 530L are moved to the lower limit position. The flow of tokens M is prevented by the support member 534, which will be, however, disregarded for simplifying the explanation. Further, even where the guide units 530R and 530L are moved to the upper limit position, the ball guide plate 531 projects above the main table 501, thereby a flow of the balls B1 and B2 is restricted by the ball guide plate 531. In other words, the balls B1 and B2 are guided to a direction of the front end 501*a* so as not to fall from the side end 501*b* of the main table 501.

As described above, in the present embodiment, the guide units 530R and 530L are moved to the lower limit position, in other words, the token guide plate 533 of the guide units 530R and 530L is accommodated below the main table 501, by which the flow of ball B1 is restricted to a direction of the front end 501*a* and the tokens M are allowed to flow in any relatively arbitrary direction. As a result, of the tokens M dropped from the main table 501, the tokens M dropped from the side end 501*b* can be made higher in ratio. On the other hand, the guide units 530R and 530L are moved to the upper limit position, in other words, the token guide plate 533 of the guide units 530R and 530L is allowed to project above the main table 501, by which the flow of tokens M can be restricted to a direction of the front end 501*a*, together with the flow of the ball B1. As a result, the flow of tokens M can be concentrated in a direction of the front end 501*a*, thus making it possible to drop many tokens M from the front end 501*a* and also decrease a ratio of the tokens M dropped from the side end 501*b*.

(Constitution of Token Inserting Mechanism)

Figure 11:
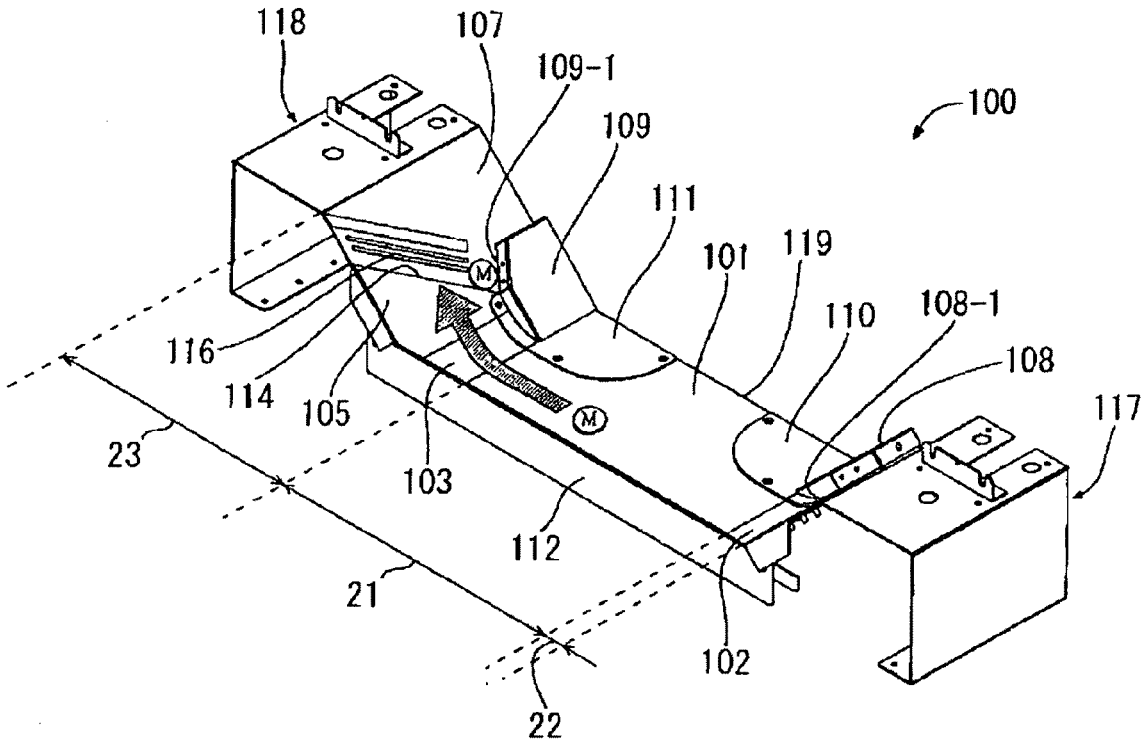
FIG. 11 is a perspective view showing a token inserting mechanism of the station unit.

FIG. 11 is a perspective view showing the token inserting mechanism 100 of the present embodiment.

Figure 12:
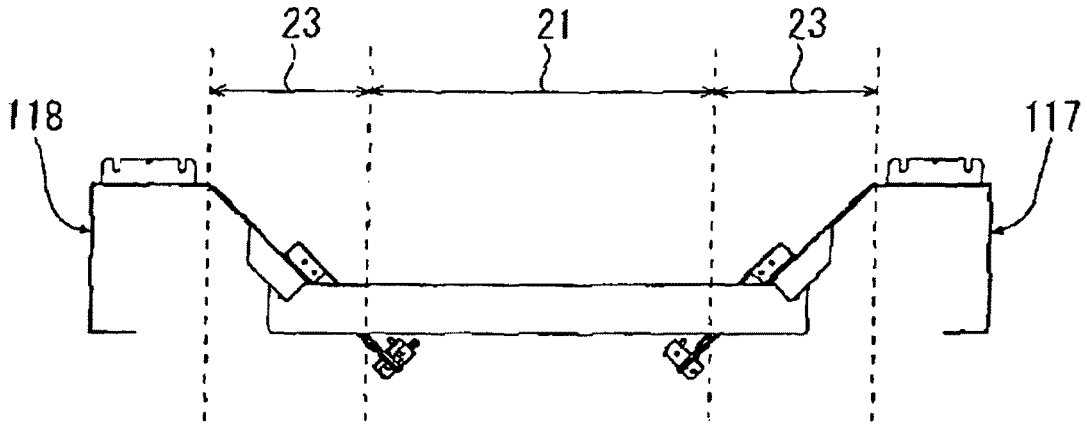
FIG. 12 is a front view of the token inserting mechanism.

FIG. 12 is a front view of the token inserting mechanism 100.

Figure 13:
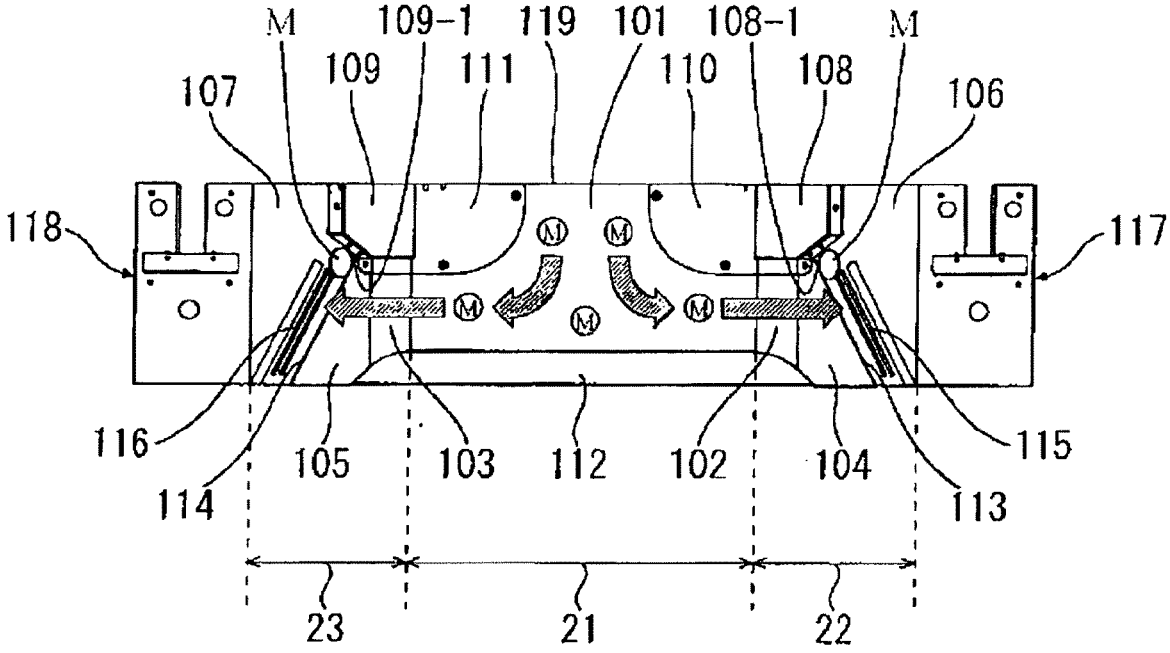
FIG. 13 is a top view of the token inserting mechanism.

FIG. 13 is a top view of the token inserting mechanism 100.

Figure 14:
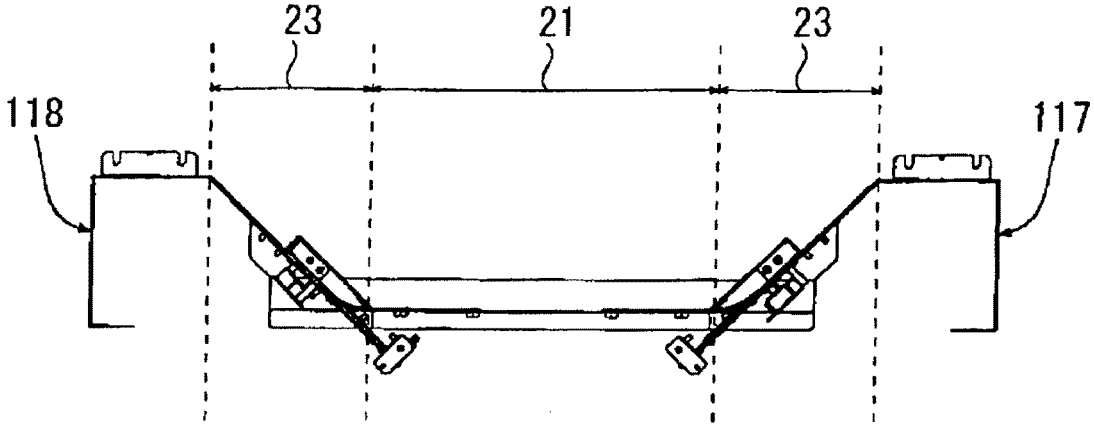
FIG. 14 is a front perspective diagram of the token inserting mechanism.

FIG. 14 is a front perspective diagram of the token inserting mechanism 100.

The token inserting mechanism 100 includes a horizontal region 21, a first sloping region 22 and a second sloping region 23 located on both sides of the horizontal region 21, a first side structure 117 located outside the first sloping region 22, and a second side structure 118 located outside the second sloping region 23. The token inserting mechanism 100 also includes a storing portion 101 for storing a plurality of tokens. The storing portion 101 constitutes the horizontal region 21 of the token inserting mechanism 100.

The token inserting mechanism 100 further includes a first sloping wall extending while sloping upward continuously from a first boundary region 102 in contact with a first side unit of the storing unit 101. The first sloping wall forms the first sloping region 22. The first sloping wall is constituted with a first sloping-wall-lower-region 104 and a first sloping-wall-upper-region 106. The first boundary region 102 is constituted with curved surfaces.

The token inserting mechanism 100 further includes a second sloping wall extending while sloping upward continuously from a second boundary region 103 in contact with a second side unit of the storing portion 101 located on the side opposite to the first side unit. The second sloping wall forms the second sloping region 23. The second sloping wall is constituted with a second sloping-wall-lower-region 105 and a second sloping-wall-upper-region 107. The second boundary region 103 is constituted with curved surfaces.

The token inserting mechanism 100 still further includes a first token inserting unit 108 having a first token inserting port 108-1 in close proximity to the first sloping wall and a second token inserting unit 109 having a second token inserting port 109-1 in close proximity to the second sloping wall. The first boundary region 102, the first sloping-wall-lower-region 104, the first sloping-wall-upper-region 106, and the first token inserting unit 108 form the first sloping region 22 of the token inserting mechanism 100. The second boundary region 103, the second sloping-wall-lower-region 105, the second sloping-wall-upper-region 107 and the second token inserting unit 109 form the second sloping region 23 of the token inserting mechanism 100.

The first token inserting unit 108 is additionally provided with a first fixing flange 110, and the first fixing flange 110 extends from part of the first boundary region 102 to part of the storing unit 101. The second token inserting unit 109 is also provided with a second fixing flange 111, and the second fixing flange 111 extends from part of the second boundary region 103 to part of the storing unit 101. As shown in FIG. 13, the first fixing flange 110 and the second fixing flange 111 extending on the storing portion 101 are provided with a greatly rounded angular unit. The first fixing flange 110 and the second fixing flange 111 define a token storing region for storing tokens M at the storing unit 101. The first fixing flange 110 and the second fixing flange 111 are spaced away from each other, and the tokens M are supplied from a token supply side 119 between the two flanges 110, 111. The thus supplied tokens M are constrained at a greatly rounded angular unit between the first fixing flange 110 and the second fixing flange 111. A first token constraining plate 112 for preventing the tokens M supplied from the storing portion 101 to the front side where a player is situated from being dropped is arranged at the side unit opposite to the token supply side 119 of the storing unit 101.

A first guide unit 113 is formed on a boundary between a first sloping-wall-lower-region 104 and a first sloping-wall-upper-region 106. The first guide unit 113 is constituted so as to lock tokens sliding down on the first sloping-wall-upper-region 106 and allow the tokens to slide rotationally into a first token inserting port 108-1 along the first guide unit. The first guide unit 113 is constituted with a first step 113 formed on a boundary between the first sloping-wall-lower-region 104 and the first sloping-wall-upper-region 106. The first step 113 extends while linearly descending toward the first token inserting port 108-1. The first sloping-wall-upper-region 106 is provided with at least one projection formed so as to reduce friction between the tokens M sliding rotationally along the first guide unit 113. In other words, the first sloping-wall-upper-region 106 is provided with at least one ridge line-shaped projection 115 which is spaced upward only by a distance smaller than a diameter of the token M from the first guide unit 113 and extending substantially parallel to a direction at which the first guide unit 113 extends. Concretely, as shown in the drawing, a plurality of ridge line-shaped projections 115 is formed.

The second guide unit 114 is formed on a boundary between a second sloping-wall-lower-region 105 and a second sloping-wall-upper-region 107. The second guide unit 114 is constituted so as to lock tokens sliding down on the second sloping-wall-upper-region 107 and allow the tokens to slide rotationally to a second token inserting port 109-1 along the second guide unit. The second guide unit 114 is constituted with a second step 114 formed on a boundary between the second sloping-wall-lower-region 105 and the second sloping-wall-upper-region 107. The second step 114 extends while linearly descending to the second token inserting port 109-1. The second sloping-wall-upper-region 107 is provided with at least one projection formed so as to reduce friction between the tokens M sliding rotationally along the second guide unit 114. In other words, the second sloping-wall-upper-region 107 is provided with at least one ridge line-shaped projection 116 which is spaced upward only by a distance smaller than a diameter of the token M from the second guide unit 114 and extending substantially parallel to a direction at which the second guide unit 114 extends. Specifically, as shown in the drawing, a plurality of ridge line-shaped projections 116 is formed.

The outer upper end unit of the first sloping-wall-upper-region 106 is coupled to a first side structure 117. The first side structure 117 is formed in a deformed L-shaped cross sectional shape and constituted with a horizontal upper unit, a vertical wall unit and a horizontal lower unit. The horizontal upper unit extends continuously outward from the outer upper end unit of the first sloping-wall-upper-region 106. The vertical wall unit extends from the outer end unit of the horizontal upper unit downwardly in a perpendicular direction. The horizontal lower unit extends inward from the lower end unit of the vertical wall unit. The horizontal upper unit is provided with an operating handle used in a control system for controlling the position and orientation of a discharge end unit of the token discharge channel 400, and a player manipulates the operating handle to control the position and orientation of the discharge end unit of the token discharge channel 400. The horizontal lower unit acts as a fixing flange for fixing the token inserting mechanism 100 to the cabinet 800 of the station unit ST.

The outer upper end unit of the second sloping-wall-upper-region 107 is coupled to the second side structure 118. The second side structure 118 is formed in a deformed L-shaped cross sectional shape and constituted with a horizontal upper unit, a vertical wall unit and a horizontal lower unit. The horizontal upper unit extends continuously outward from the outer end unit of the second sloping-wall-upper-region 107. The vertical wall unit extends from the outer end unit of the horizontal upper unit downward vertically. The horizontal lower unit extends inward from the lower end unit of the vertical wall unit. The horizontal upper unit is provided with an operating handle used in a control system for controlling the position and orientation of a discharge end unit of the token discharge channel 400, and a player manipulates the operating handle to control the position and orientation of the discharge end unit of the token discharge channel 400. The horizontal lower unit acts as a fixing flange for fixing the token inserting mechanism 100 to the cabinet 800 of the station unit ST.

If the storing unit 101, the first boundary region 102, the second boundary region 103, the first sloping-wall-lower-region 104, the second sloping-wall-lower-region 105, the first sloping-wall-upper-region 106 and the second sloping-wall-upper-region 107 are constituted with the same member, there are no seams at a region where tokens M are moved, thus making it possible to reduce resistance.

Further, the first token inserting port 108-1 of the first token inserting unit 108 and the second token inserting port 109-1 of the second token inserting unit 109 are given such dimensions that only one token M is allowed to enter. This is to reliably prevent tokens M from clogging at the first token inserting unit 108 or the second token inserting unit 109, if a plurality of tokens M enter into the first token inserting port 108-1 or the second token inserting port 109-1 at the same time.

The above-described token inserting mechanism 100 is configured and structured substantially symmetrically based on an intermediate position between the first side unit and the second side unit.

Figure 15:
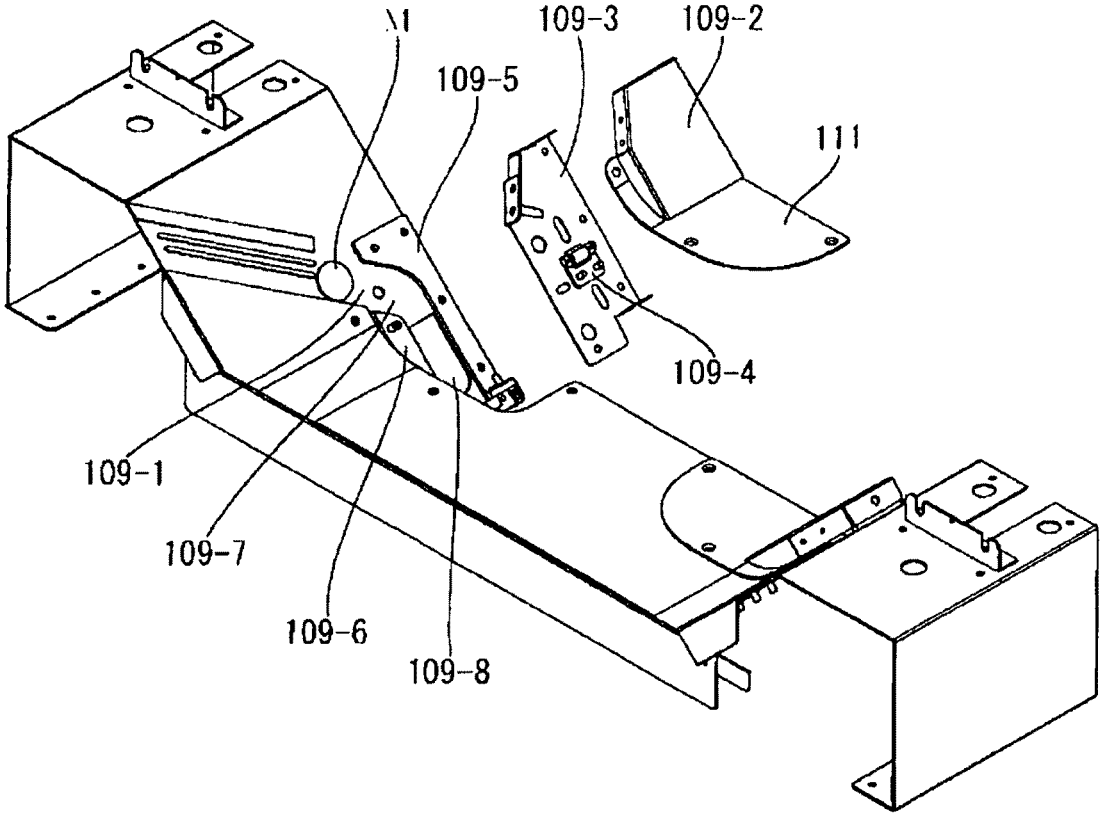
FIG. 15 is a partial exploded view of the token inserting mechanism.

FIG. 15 is a partial exploded view of the token inserting mechanism 100.

Since the first token inserting unit 108 is identical in structure to the second token inserting unit 109, hereinafter, the second token inserting unit 109 is taken as an example to explain the internal structure thereof.

The second token inserting unit 109 is provided with a second guide unit 114, that is, a second token inserting port 109-1 in close proximity to the dead end unit of the second step unit 114, a token inserting channel 109-7 communicatively connected to the dead end unit of the second step unit 114, a token dropping hole 109-8 communicatively connected to the token inserting channel 109-7, a first token guide plate 109-5 and a second token guide plate 109-6 defining respectively the token inserting channel 109-7 and both side units of the token inserting channel 109-7. The token inserting channel 109-7 is formed so as to guide tokens M inserted via the second token inserting port 109-1 up to the token dropping hole 109-8.

Further, the second token inserting unit 109 is provided with a first intermediate plate 109-3 having a first roller 109-4. The first intermediate plate 109-3 is attached to the first token guide plate 109-5 and the second token guide plate 109-6. The first roller 109-4 is located above the token dropping hole 109-8, by which when tokens M which have passed through the token inserting channel 109-7 are brought almost above the token dropping hole 109-8, the metals M brought into contact with the first roller 109-4 and slightly pushed downward and dropped through the token dropping hole 109-8. The thus dropped tokens M are transferred via a token transfer channel 200 shown in FIG. 5 to a lift-up hopper 300. Then, the tokens M are lifted up by the lift-up hopper 300 to the supply end of a token discharge channel 400, and supplied via the token discharge channel 400 from the discharge end onto the play field 500. The second token inserting unit 109 is additionally provided with a first token-inserting-unit-cover 109-2. The first token-inserting-unit-cover 109-2 covers a first intermediate plate 109-3. Further, the first token-inserting-unit-cover 109-2 is formed integrally with a second fixing flange 111, and the second fixing flange 111 is fixed to the storing unit 101, thereby the position thereof is indirectly fixed with respect to the first intermediate plate 109-3.

A player allows a token M stored at the storing portion 101 to slide upward to the first sloping-wall-lower-region 104 and the first sloping-wall-upper-region 106 extending while sloping continuously upward from the storing portion 101 as well as the second sloping-wall-lower-region 105 and the second sloping-wall-upper-region 107, and when the player lets go of the token M, the token M slides down from the first sloping-wall-upper-region 106 and the second sloping-wall-upper-region 107 due to gravitational force and is locked by a first step unit 113 constituting the first guide unit 113 and a second step unit 114 constituting the second guide unit 114. Then, the first step unit 113 and the second step unit 114 are constituted so that the token M is allowed to slide rotationally to the first token inserting port 108-1 and the second token inserting port 109-1 due to gravitational force.

In other words, a player allows a token M to slide upward to the first sloping-wall-lower-region 104 and the first sloping-wall-upper-region 106 extending while sloping continuously upward from the storing portion 101 as well as the second sloping-wall-lower-region 105 and the second sloping-wall-upper-region 107, thereafter, when the player lets go of the token M, the token M slides down from the first sloping-wall-upper-region 106 and the second sloping-wall-upper-region 107 due to gravitational force and is locked by the first step unit 113 and the second step unit 114, and the token M then slides rotationally to the first token inserting port 108-1 and the second token inserting port 109-1 of the first inserting unit along the first step unit 113 and the second step unit 114 due to gravitational force. When the token M rolls over along the first step unit 113 and the second step unit 114, the token M is to slide with respect to the first sloping-wall-upper-region 106 and the second sloping-wall-upper-region 107. In other words, the player only allows the token M to slide upward from the storing portion 101 along the first sloping-wall-lower-region 104, the first sloping-wall-upper-region 106, the second sloping-wall-lower-region 105 and the second sloping-wall-upper-region 107 and lets go of the token, thereby facilitating motion of the hand of the player as compared with a conventional operation to manually bring the token M to the token inserting port and inert it into the token inserting port. Therefore, if the player continues to insert tokens M for a long time, player fatigue can be reduced to a great extent. Further, since the tokens M can be inserted with almost no attention, the player can concentrate on a game itself and enjoy the game fully. Still further, since the tokens M are not completely automated for the insertion but the insertion of tokens is made easier for the player. The player can play a game continuously for a long time, while actually holding the feeling of playing the game.

(Constitution of Center Drawing Device)

Next, a description is given of a constitution of the center drawing device 2000.

Figure 16:
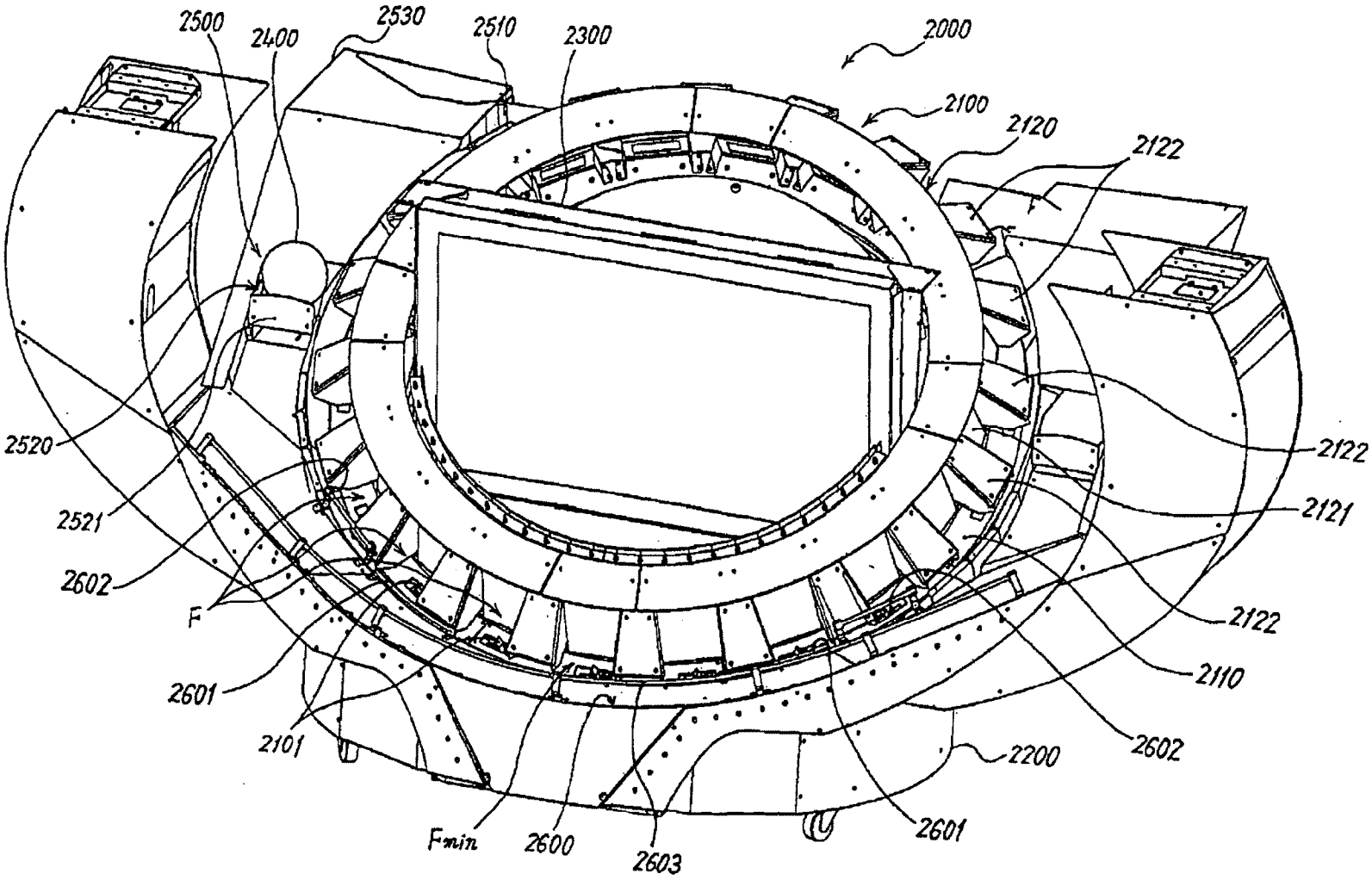
FIG. 16 is a perspective view showing a constitution of the center drawing device.

FIG. 16 is a perspective view showing the constitution of the center drawing device 2000.

Figure 17:
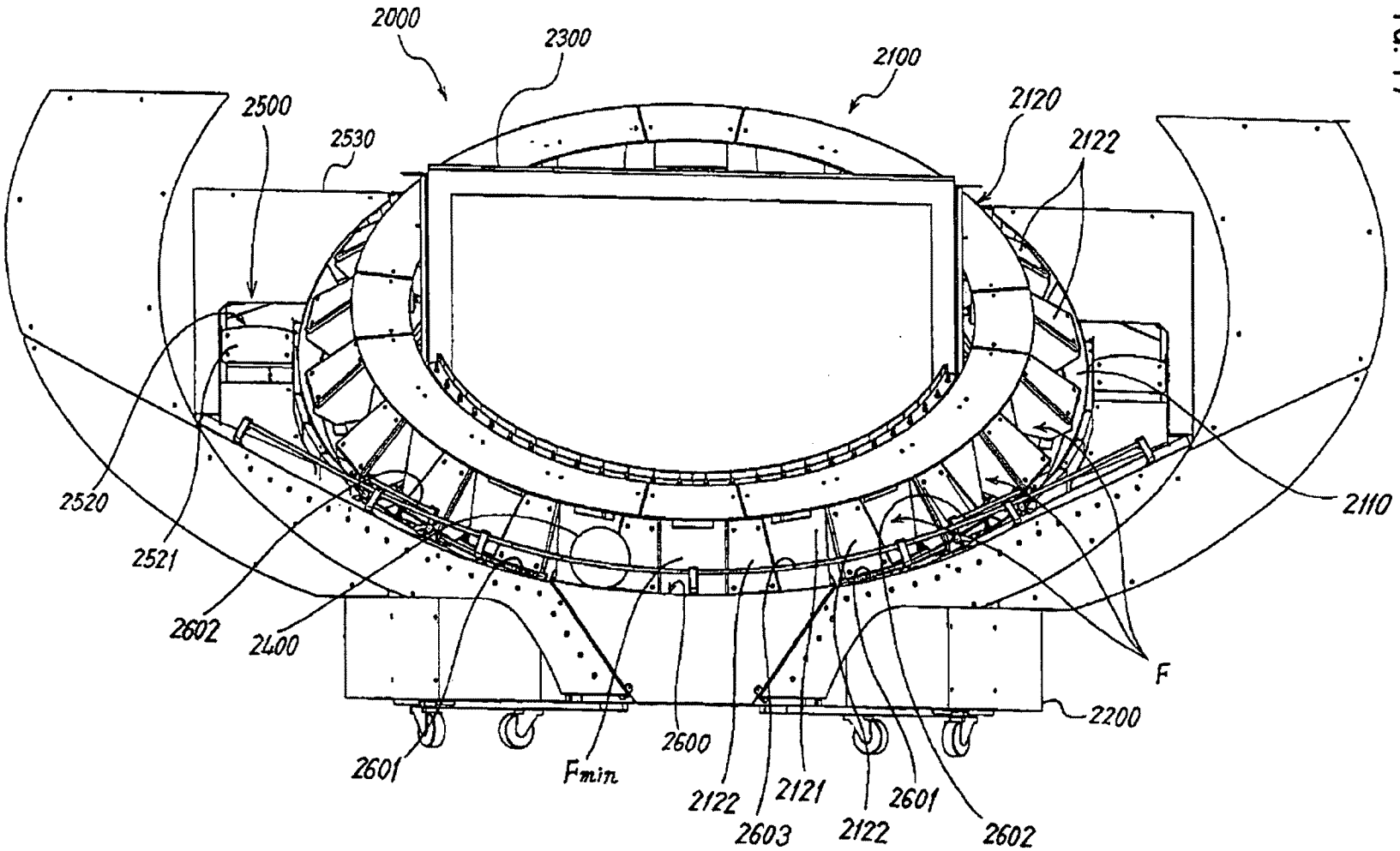
FIG. 17 is a front view showing the constitution of the center drawing device.

FIG. 17 is a front elevational view showing a constitution of the center drawing device 2000.

The center drawing device 2000 is mainly composed of a large disk-shaped rotational transfer device 2100, a device supporting base 2200 for supporting the rotational transfer device 2100 from vertically below, display device 2300, a large-ball-inserting-mechanism 2500 for inserting a large drawing ball 2400, and a transfer slope 2600 for transferring the large drawing ball 2400 inserted from the large-ball-inserting-mechanism 2500 to the rotational transfer device 2100.

The rotational transfer device 2100 is rotationally driven counterclockwise in the drawings by a driving device (not illustrated) mounted on the device supporting base 2200. The rotational transfer device 2100 constantly rotates by this driving device at a fixed cycle after the power supply of the pusher game machine 1 is turned on. A plurality of retention spaces F having an inner space for accommodating only one large drawing ball 2400 are formed in the outer circumferential direction in the outer circumferential region of the rotational transfer device 2100. In the present embodiment, twenty retention spaces F are arranged at equal intervals in the outer circumferential region of the rotational transfer device 2100.

Each of the retention spaces F rotationally moves along the outer circumference of the rotational transfer device 2100 due to the rotation of the rotational transfer device 2100. The rotational transfer device 2100 of the present embodiment is inclined both in a perpendicular direction and in a horizontal direction. Thus, each of the retention spaces F rotationally moves along a virtual flat surface inclined both in a perpendicular direction and in a horizontal direction.

The large-ball-inserting-mechanism 2500 is arranged on the left side of the rotational transfer device 2100 shown in the drawings. The large-ball-inserting-mechanism 2500 is mainly composed of a ball collecting port 2510 for receiving the large drawing ball 2400, a ball retaining part 2520 for retaining the large drawing ball 2400 received from the ball collecting port 2510, and a case 2530. The large drawing ball 2400 that has entered into the ball collecting port 2510 is transferred through the interior of the case 2530 to the ball retaining part 2520 due to its own weight and stopped by a ball stopper 2521 of the ball retaining part 2520. The ball stopper 2521 is moved between a ball retaining position for stopping the large drawing ball 2400 and a ball releasing position for releasing the large drawing ball 2400 according to control by the control unit (not illustrated) of the center drawing device 2000. In addition, FIG. 16 shows a state that the ball stopper 2521 is positioned at the ball retaining position and the large drawing ball 2400 is retained at the ball retaining part 2520. In the present embodiment, an introduction mechanism is mainly composed of the ball retaining part 2520 and the ball stopper 2521.

When the ball stopper 2521 moves from the ball retaining position to the ball releasing position to release a retaining state of the ball retaining part 2520, the large drawing ball 2400 retained at the ball retaining part 2520 rolls into the transfer slope 2600 as a guiding mechanism by its own weight. Thereby, as shown in FIG. 17, the large drawing ball 2400 rolls on the transfer slope 2600 by its own weight, moving like a pendulum around a lowest point on a slope surface (upper face) which is an inclined face of the transfer slope 2600. The transfer slope 2600 is provided with the slope surface (a inclined face) that a lowest point thereof is a point at which the large drawing ball 2400 is placed when the large drawing ball 2400 is present at a position adjacent to a lowest point of a retention-space-moving-channel on which each of the retention spaces F of the rotational transfer device 2100 rotationally moves. Thereby, the large drawing ball 2400 is let into a drawing slot of any one of the retention spaces F by the slope surface. The slope surface is formed in such a manner that the large drawing ball 2400 can move adjacently with respect to one or two or more retention spaces F including a retention space $F_{min}$ positioned at a lowest point of the retention-space-moving-channel. In the present embodiment, the slope surface is formed so that the large drawing ball 2400 can move adjacently with respect to the total three retention spaces F including two retention spaces F adjacent thereto when the retention space $F_{min}$ is positioned exactly at the lowest point of the retention-space-moving-channel.

More specifically, on a retention-space-moving-channel side of the transfer slope 2600, entry preventive barriers 2601 and 2602 are arranged on both sides of a space that is an entry space covering three retention spaces positioned at the center of the lowest point. These entry preventive barriers 2601 and 2602 prevent the large drawing ball 2400 on the slope surface from moving to the retention-space-moving-channel of the rotational transfer device 2100 beyond the entry preventive barriers 2601 and 2602. Further, part of the slope surface at least facing the entry space is constituted so as to incline toward the retention-space-moving-channel of the rotational transfer device 2100. Therefore, the large drawing ball 2400 inserted from the large-ball-inserting-mechanism 2500 moves on the transfer slope 2600 like a pendulum around the lowest point and a moving speed thereof gradually reduces, finally the large drawing ball 2400 moves toward the retention-space-moving-channel side of the slope surface by the inclination and its own weight, and thereafter moves via the entry space to the retention-space-moving-channel of the rotational transfer device 2100. In this point, the large drawing ball 2400 enters into a drawing slot of the retention space F present at a position facing the entry space among the retention spaces F moving rotationally by the rotation of the rotational transfer device 2100.

In the present embodiment, the transfer slope 2600 is constituted so that the lowest point thereof inclines the most toward the rotational transfer device 2100 and the large drawing ball 2400 can enter into the retention space F of the rotational transfer device 2100 more easily as it comes closer to the lowest point of the transfer slope 2600. The transfer slope 2600 is also provided with a guide barrier 2603 all over the end part at the opposite side of the transfer slope 2600 so that the large drawing ball on the transfer slope 2600 does not fall on the side (front side in the drawings) opposite to the retention-space-moving-channel.

As shown in FIG. 16, a ball sensor 2101 for detecting the fact that the large drawing ball 2400 has entered into the corresponding retention space F is arranged inside each of the retention spaces F of the rotational transfer device 2100. Each of the ball sensors 2101 is connected to the control unit (not illustrated) of the center drawing device 2000 and the detection signal is to be sent to the control unit. Thereby, the control unit of the center drawing device 2000 is able to grasp which of the retention spaces F the large drawing ball 2400 has entered.

When the large drawing ball 2400 on the transfer slope 2600 is retained by any one of the retention spaces F, the large drawing ball is transferred rotationally counterclockwise in the drawings along the retention-space-moving-channel by rotational movement of the retention space F. In this instance, the ball collecting port 2510 of the large-ball-inserting-mechanism 2500 is adjacent to the retention-space-moving-channel and arranged above in a perpendicular direction from the ball retaining part 2520. A collecting place at which the ball collecting port 2510 is arranged is provided in a range from the lowest point of the retention-space-moving-channel to 180° or less in a rotational direction of the rotational transfer device 2100. Thereby, before the large drawing ball 2400 is transferred rotationally at approximately 180° after entry into the retention space F, the large drawing ball 2400 can be collected. If the large drawing ball is to be transferred rotationally in excess of 180°, it takes a needless amount of time from a point in time when the drawing result of a jackpot game is announced upon entry of the large drawing ball 2400 into the retention space F in the vicinity of the lowest point of the retention-space-moving-channel to a point in time when the ball is collected and the drawing of another jackpot game is carried out. In other words, since the performance effect of the jackpot game can be expected during the rotational transfer after the large drawing ball 2400 has entered into the retention space F, it is beneficial that the large drawing ball 2400 is rotationally transferred for a short while after the drawing result is announced. However, if the performance by rotational transfer is made excessively for a long time, the effect of performance by the rotational transfer is decreased to cause a next drawing of the jackpot game by using the large drawing ball 2400 to wait, which may not be favorable. Therefore, in the present embodiment, before the large drawing ball 2400 is transferred rotationally by approximately 180° after entry into the retention space F, the large drawing ball 2400 is to be collected. On the other hand, if the large drawing ball 2400 is collected immediately after it has entered into the retention space F, the effect of performance by the rotational transfer is not sufficiently obtained. Thus, it is preferable that the large drawing ball 2400 is transferred rotationally, for example, by 90° or more.

Further, in the present embodiment, there is a movement mechanism for moving the large drawing ball 2400 in the retention space F to the ball collecting port 2510 only by its own weight when the retention space F retaining the large drawing ball 2400 rotationally moves to a collecting space and opposes the ball collecting port 2510. Hereinafter, a description is given of a constitution of the movement mechanism.

Figure 18:
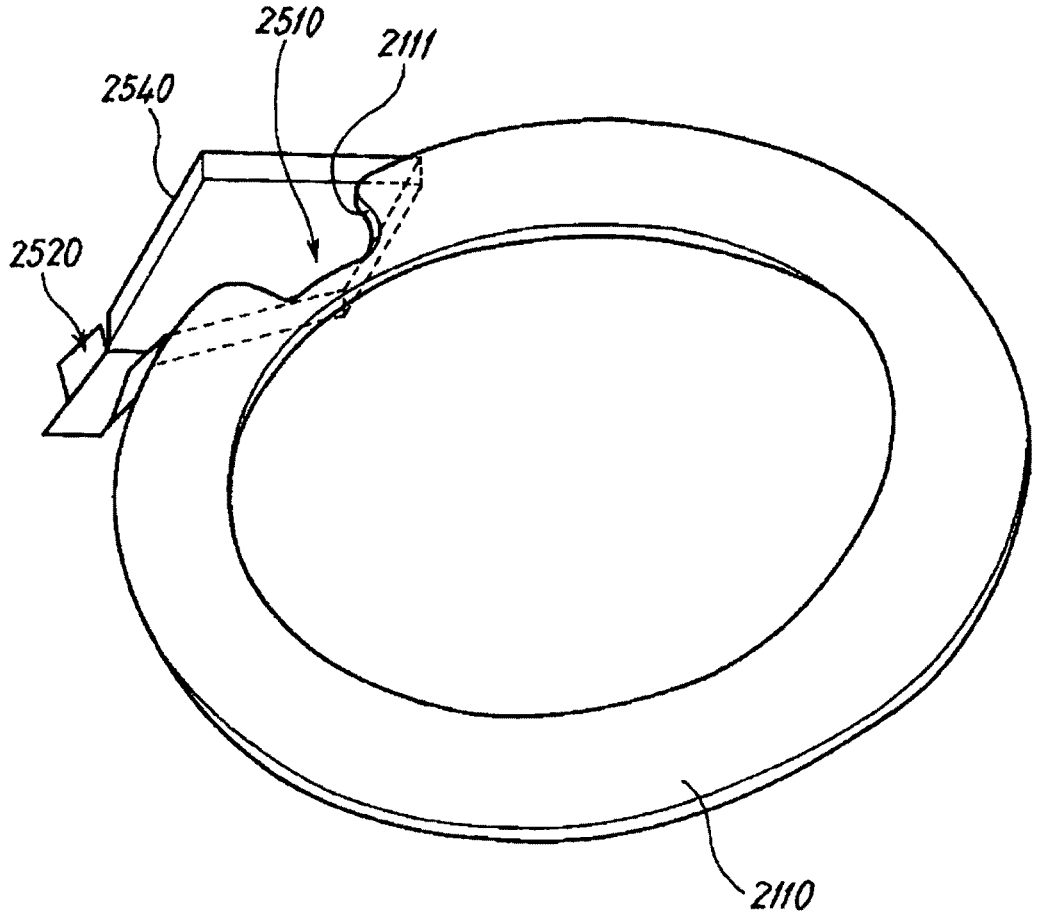
FIG. 18 is an explanatory view showing part of a rotational transfer device in the center drawing device.

FIG. 18 is an explanatory view showing part of the rotational transfer device 2100.

As shown in FIG. 16, the rotational transfer device 2100 of the present embodiment is provided with a doughnut-shaped bottom plate 2110 to be fixed and a rotating member 2120 to be arranged on the doughnut-shaped bottom plate 2110 for rotational movement. The rotating member 2120 is driven by a driving mechanism (not illustrated) to rotationally move on the doughnut-shaped bottom plate 2110. The rotating member 2120 is composed of a doughnut-shaped base 2121 and twenty partition members 2121 arranged radially on the outer circumferential face of the doughnut-shaped base 2121. In the present embodiment, regions mainly surrounded by the outer circumferential face of the doughnut-shaped base 2121, each of two opposing faces mutually adjacent partition members 2121 and the upper face of the doughnut-shaped bottom plate 2110 form respective retention spaces F. Therefore, when the rotating member 2120 is rotationally moved, the retention spaces F move on the upper face of the doughnut-shaped bottom plate 2110.

Further, as shown in FIG. 18, a notch 2111 is formed on the doughnut-shaped bottom plate 2110. The ball collecting port 2510 of the large-ball-inserting-mechanism 2500 is positioned below the notch 2111. Therefore, When the retention spaces F move in accordance with rotationally movement of the rotating member 2120 and thereby the retention space F retaining the large drawing ball 2400 reaches a position facing the notch 2111, the large drawing ball 2400 falls from the notch 2111 only by its own weight and falls via the ball collecting port 2510 to a communication channel 2540 arranged inside the case 2530. Since the bottom of the communication channel 2540 is inclined toward the ball retaining part 2520, the large drawing ball 2400 fallen into the communication channel 2540 is transferred by its own weight through the communication channel 2540 to the ball retaining part 2520.

The movement mechanism for moving the large drawing ball 2400 inside the retention space F to the ball collecting port 2510 shall not be limited to that described above, and any movement mechanism is acceptable as long as it has a constitution, when the retention space F is in a position facing the collecting space, the large drawing ball 2400 inside the retention space F can be moved to the ball collecting port 2510 only by its own weight or by utilizing a rotational driving force of the rotational transfer device 2100.

For example, the movement mechanism utilizing the rotational driving force of the rotational transfer device 2100 includes a mechanism using a contact member which is brought into contact with the large drawing ball 2400 when the retention space F retaining the large drawing ball 2400 rotationally moves to the collecting space to oppose the ball collecting port. Specifically, the mechanism is structured so that the ball collecting port is arranged outside the outer circumferential face of the retention-space-moving-channel and the large drawing ball 2400, which is in rotational transfer, is caught by the contact member and pushed outside the outer circumferential face of the retention-space-moving-channel.

Figure 2:
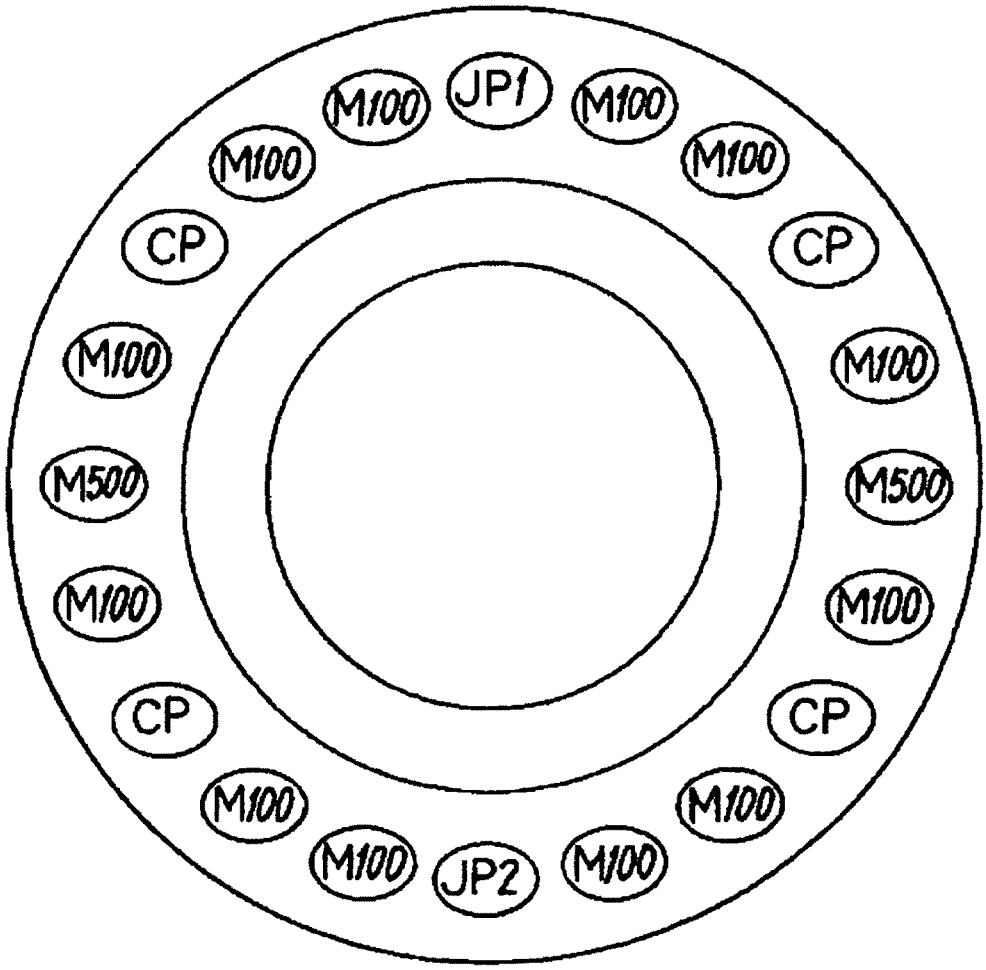
FIG. 2 is an explanatory view showing schematically a corresponding relationship between prizes and twenty retention spaces composed of a center drawing device in the pusher game machine.

FIG. 2 is an explanatory view showing schematically a corresponding relationship between prizes and twenty retention spaces F.

In the present embodiment, a prize is allocated to each of the retention spaces F. In the present embodiment, the prizes include token supply prizes M100 and M500, a chance pocket prize CP and jackpot prizes JP1 and JP2. In the center drawing device 2000, a physical drawing (jackpot game) about which of the retention spaces F the large drawing ball 2400 enters into is carried out.

The token supply prizes M100 and M500 supply respectively 100 pieces and 500 pieces of tokens M to the play field 500 of the station unit ST in which a start condition of the jackpot game are satisfied. In addition, the number of tokens supplied on winning the token supply prizes M100, M500 is preferably smaller than an initial value of the jackpot value.

Further, the chance pocket prize CP is an prize that when the prize is awarded, the above-described predetermined event condition is satisfied, thereby during a subsequent predetermined event period, in the satellite unit SA to which the station unit ST satisfying the start condition of the jackpot game belongs, a winning bingo number drawn by the physical drawing carried out at the satellite drawing device 1000 at any one of the four station units ST belonging thereto is handled as a winning bingo number also in the other three station units ST.

Still further, the chance pocket prize CP is handled as a payout-amount increasing prize. That is, the chance pocket prize CP is a prize that a jackpot value (payout amount) of the second jackpot prize to be described later is cumulatively increased only by a predetermined amount (for example, 100 pieces).

In addition, when the chance pocket prize CP is awarded, 100 pieces of tokens M are supplied to the play field 500 of the station unit ST that satisfies the start conditions of the jackpot game. At this point, the chance pocket prize CP is also a token supply prize.

The jackpot prizes JP1 and JP2 are available as two types in the present embodiment.

The first jackpot prize JP1 is an prize that the amount of tokens M corresponding to the first jackpot value (payout amount) are supplied (paid out) to the play field 500 of the station unit ST which has satisfied the start condition of the jackpot game. The first value data (payout amount data) indicating the first jackpot value is stored at a RAM (storage unit) of the control unit (not illustrated) in the center drawing device 2000. A count value of the first value data, that is, the first jackpot value, is obtained by cumulatively adding the number of pieces (for example, 0.03 pieces) corresponding to part of the number of inserted tokens every time the tokens are inserted at all the station units ST to a predetermined initial value (for example, 500 pieces).

The second jackpot prize JP2 is an prize that the amount of tokens M corresponding to the second jackpot value (payout amount) are supplied (paid out) to the play field 500 of the station unit ST which has satisfied the start condition of the jackpot game. The first value data (payout amount data) indicating the second jackpot value is also stored at the RAM (storage unit) of the control unit (not illustrated) of the center drawing device 2000. A count value of the second value data, that is, the first jackpot value, is obtained by cumulatively adding a predetermined amount (for example, 100 pieces) every time the chance pocket prize CP is awarded in the preceding jackpot game to a predetermined initial value (for example, 500 pieces).

In the present embodiment, the control unit (not illustrated), which is a payout-amount increasing unit, of the center drawing device 2000 handling the above-described addition processing functions as payout-amount increasing means.

Further, in the present embodiment, the number of tokens supplied to the play field 500 when these jackpot prize JP1 or JP2 is awarded, that is, the jackpot value, is set to be largest in number among the number of tokens which can be supplied at one time to the play field 500 in the present pusher game machine 1. Therefore, a player who plays at the present pusher game machine 1 usually plays aiming at obtaining these jackpot prizes.

Figure 19:
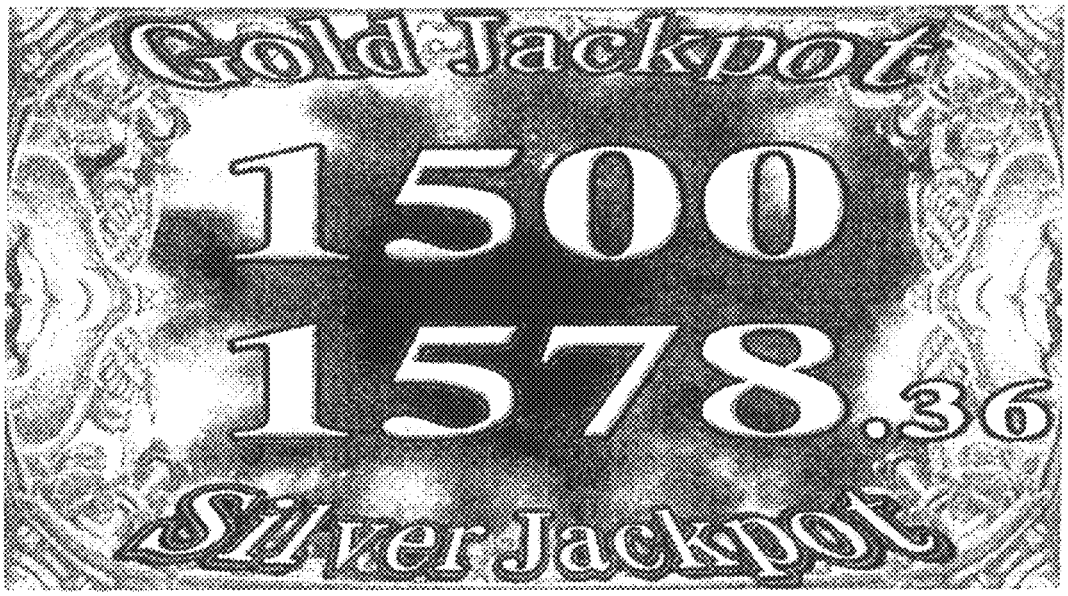
FIG. 19 is an explanatory view showing one example of a screen displayed on a display device of the center drawing device.

Further, as shown in FIG. 19, the display device 2300 of the center drawing device 2000 displays a screen indicating the present jackpot value, that is, the number of tokens which are to be supplied to the play field 500 when the jackpot prize JP1 or JP2 is awarded, during a period in which no jackpot game is carried out. On the other hand, during a period in which a jackpot game is carried out, a screen for performing the jackpot game is displayed.

On starting a jackpot game, the device supporting base 2200 itself rotates around a rotating shaft parallel to a perpendicular direction by a driving device (not illustrated), thereby the center drawing device 2000 moves to face the front of the satellite unit SA belonging to the station unit ST which has satisfied the start condition of the jackpot game. Thereafter, the jackpot game is allowed to progress. The jackpot game will be explained in details later.

(Constitution of Game Control System)

Figure 20:
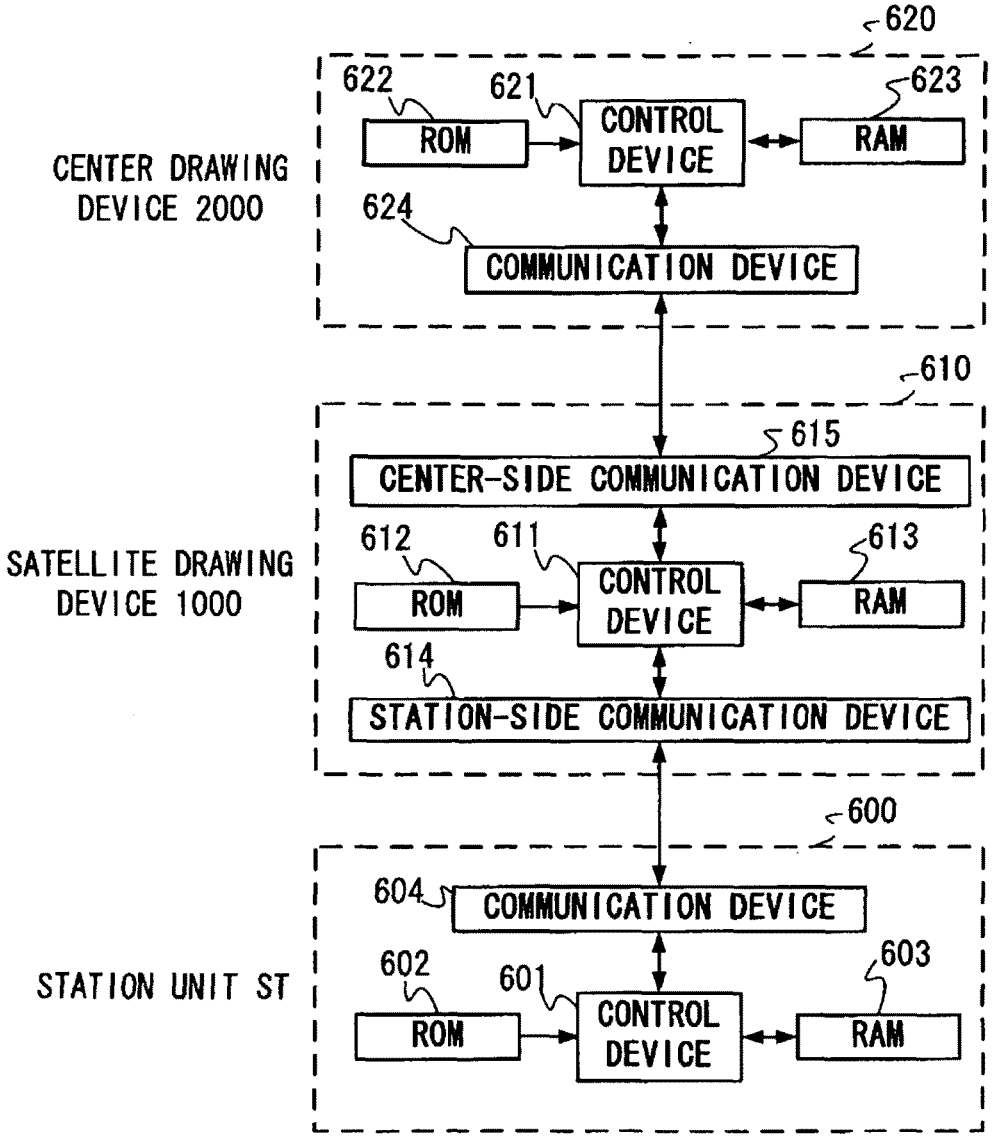
FIG. 20 is a block diagram showing a major constitution of a game control system in the pusher game machine.

FIG. 20 is a block diagram showing a major constitution of the game control system of the present pusher game machine 1. In addition, in the block diagram, a constitution of a driving control system or the like for driving each part according to the progression of the game is omitted for the convenience of explanation.

The game control system of the present embodiment is mainly composed of the control unit 600 of the station unit ST, a control unit 610 of the satellite drawing device 1000 and a control unit 620 of the center drawing device 2000. The control unit 600 of the station unit ST is mainly in charge of a comprehensive control of progression of the above-described slot game and bingo game. The control unit 610 of the satellite drawing device 1000 is mainly in charge of controlling the physical drawing of the above-described bingo game and controlling the transfer of the balls B1 and B2. The control unit 620 of the center drawing device 2000 is mainly in charge of controlling the above-described jackpot game.

The control unit 600 of the station unit ST is mainly composed of a control device 601, a ROM 602, a RAM 603 and a communication device 604. The control device 601 executes various types of programs stored at the ROM 602, and thereby carries out various types of control. The ROM 602 stores programs and others for carrying out various types of control to be carried out at the control unit 600 of the station unit ST. The RAM 603 temporarily stores various types of data or information. The communication device 604 carries out data communications with the control unit 610 of the satellite drawing device 1000.

The control unit 610 of the satellite drawing device 1000 is mainly composed of a control device 611, a ROM 612, a RAM 613, a station-side communication device 614 and a center-side communication device 615. The control device 611 executes various types of programs stored at the ROM 612, and thereby carries out types of control. The ROM 612 stores programs and others for carrying out various types of control to be carried out at the control unit 610 of the satellite drawing device 1000. The RAM 613 temporarily stores various types of data or information. The station-side communication device 614 carries out data communications with the control unit 600 of each of the station unit ST belonging to this satellite unit SA. The center-side communication device 615 carries out data communications with the control unit 620 of the center drawing device 2000.

The above-described constitution has been explained for a case where the control unit 600 of the station unit ST, the control unit 610 of the satellite drawing device 1000 and the control unit 620 of the center drawing device 2000 are connected in series. However, these control units 600, 610, 620 may be connected parallel to each other (star type or bus type).

(Flow of Slot Game)

Next, a description is given of a flow of the slot game which progresses in the pusher game machine 1 in the present embodiment.

Figure 21:
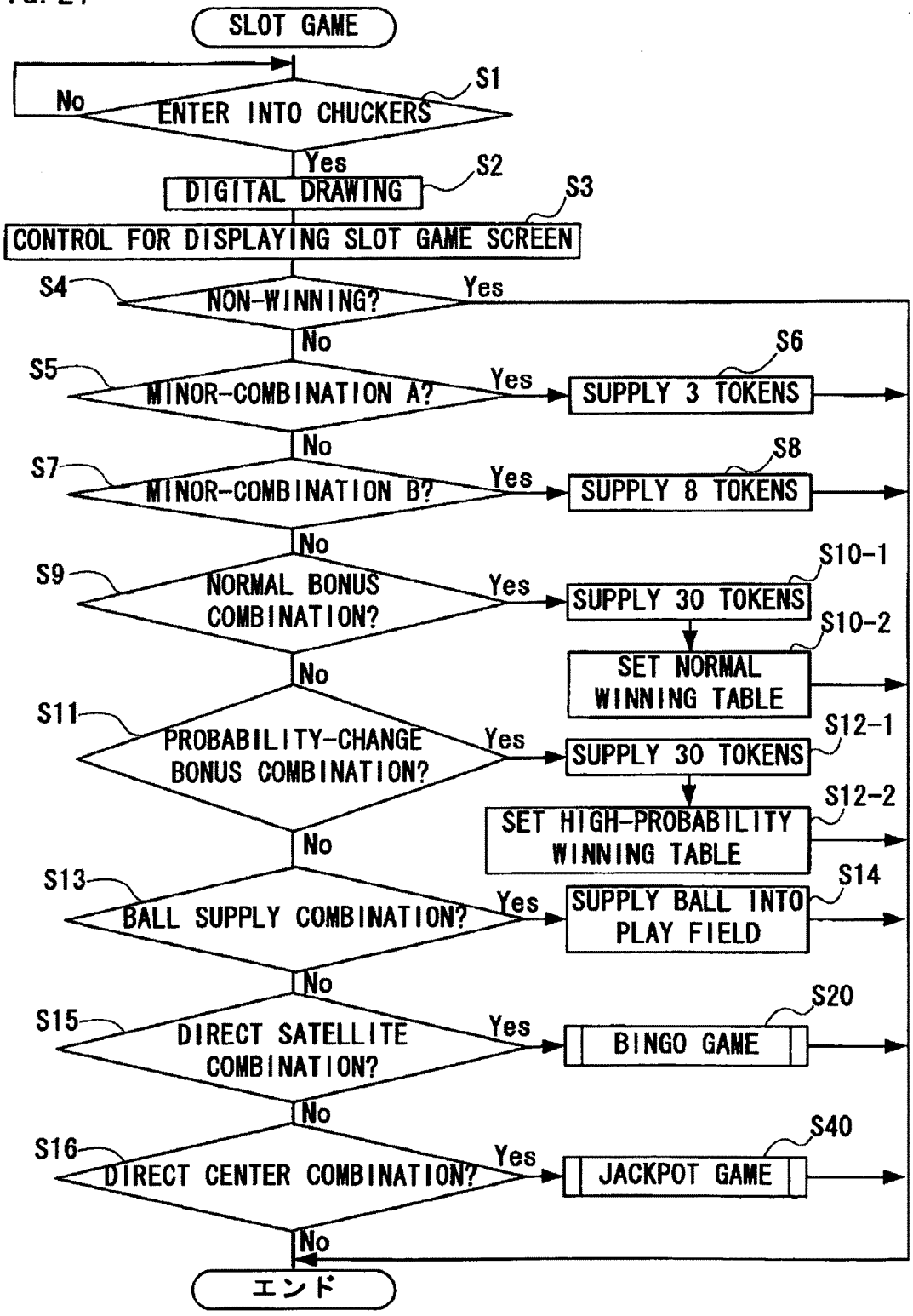
FIG. 21 is a flow chart showing a flow of a slot game carried out in the pusher game machine.

FIG. 21 is a flow chart showing the flow of the slot game in the present embodiment.

When a player inserts tokens M on the storing portion 101 into the first token inserting port 108-1 or the second token inserting port 109-1 in a manner as described above, tokens M are inserted to the sub-table 511 inside the play field. Then, when, of the tokens M which have been dropped from the sub-table 511, part of them enters into any one of chuckers 515-1, 515-2 and 515-3 arranged on the sloping table 512 and is detected by a token detecting unit (not illustrated) functioning as token detecting means, its detection signal is sent to the control device 601 of the control unit 600 of the station unit ST, and thereby the control device 601 comprehends that the token M has entered into any one of the chuckers 515-1, 515-2 and 515-3 (S1). Thereby, the control device 601 determines that the start condition of the slot game is satisfied and executes a drawing program stored at the ROM 602. Thereby, the control device 601 carries out the digital drawing for deciding whether a winning which any one of the above specific-combinations is awarded or a non-winning by referring to a predetermined winning table and using a generated random number (S2). Further, the control device 601 carries out a display control of rotating the three dice-shaped slots DS on the slot game screen shown in FIG. 6, which is displayed on the display unit 700, and thereafter carries out a display control of halting the rotation of the three dice-shaped slots DS so that where a winning combination is decided by the digital drawing, a pattern of symbols related to the winning combination is halted and displayed on the display unit 700 (S3).

Where the non-winning that is any one of the specific-combinations is not awarded by the above digital drawing (S4), the control device 601 finishes the slot game as it is.

On the other hand, where the minor-combination A is awarded (S5), the control device 601 controls a token supply unit (not illustrated) functioning as token supply means to supply three tokens to the play field 500 (S6). The token supply unit may be commonly used with the above-described mechanism for inserting tokens M onto the sub-table 511 inside the play field when a player inserts tokens M on the storing portion 101, or it may be provided separately from the mechanism. Where the token supply unit is provided separately from the mechanism, it may be similar in constitution to the mechanism. In other words, such a constitution may be made that tokens M are lifted up to a supply end on a token discharge channel by using a lift-up hopper and supplied via the token discharge channel from a discharge end to the play field 500.

Further, where the minor-combination B is awarded (S7), the control device 601 controls the token supply unit to supply eight tokens to the play field 500 (S8).

Further, where the normal bonus combination is awarded (S9), the control device 601 controls the token supply unit to supply thirty tokens to the play field 500 (S10-1). Further, the control device 601 changes a setting so that an normal winning table in which a winning probability is set lower is used, as a winning table to be used in subsequent digital drawings (S10-2).

Further, where the probability-change bonus combination is awarded (S11), the control device 601 controls the token supply unit to supply thirty tokens to the play field 500 (S12-1). Further, the control device 601 changes a setting so that a high-probability winning table in which a winning probability is set higher is used, as a winning table to be used in subsequent digital drawings (S12-2).

Further, where the ball supply combination is awarded (S13), the control device 601 outputs the ball supply order for supplying the ball B1 to the control device 611 of the control unit 610 in the satellite drawing device 1000. Thereby, the ball B1 is delivered from the ball supply mechanism 1300 to the ball carrier 1520, and the ball B1 is delivered from the ball carrier 1520 to the ball inserting mechanism 1800 of the station unit ST at which the ball supply combination is awarded. The ball B1 that has been delivered to the ball inserting mechanism 1800 is retained temporarily by the stopper 1802 of the ball inserting slope 1801. Then, a player pushes the button 160, by which the control device 601 allows the ball B1 to be released from the stopper 1802 at a timing when the control device 601 receives its button operating signal, and the ball B1 rolls down on the ball inserting slope 1801 and is delivered to the ball-inserting-position-drawing-mechanism 1810. Then, a drawing for selecting a ball supply position on the play field 500 is carried out at a ball-inserting-position-drawing-mechanism 1810, and thereafter the ball B1 is supplied either to the back side or the front side on the main table 501 (S14). The ball-inserting-position-drawing-mechanism 1810 is constituted so that a ball receiving port through which the balls B1 and B2 are allowed to pass moves in a reciprocating manner between the front side and the back side around the lowest point of the ball inserting slope 1801. When the ball enters into the ball receiving port, this ball is supplied to the front side on the main table 501. When the ball does not enter into the ball receiving port, this ball is supplied to the back side on the main table 501. Where the ball is supplied to the front side on the main table 501, there is a shorter moving distance up to the token dropping groove as compared with a case where the ball is supplied to the back side on the main table 501, thereby the ball B1 falls more easily into the token dropping groove and the start condition of the bingo game can be satisfied more easily. As a result, a player is to play so as to push the button 160 at a timing when the ball B1 that has been retained at the stopper 1802 enters into the ball receiving port of the ball-inserting-position-drawing-mechanism 1810.

Still further, where the direct satellite combination is awarded (S15), the control device 601 outputs the ball supply order for supplying the ball B1 to the control device 611 of the control unit 610 in the satellite drawing device 1000. Thereby, the ball B1 is delivered from the ball supply mechanism 1300 to the ball carrier 1520. Thereafter, the ball carrier 1520 moves to a position opposed to the stage-ball-inserting-mechanism 1600, delivering the ball B1 to the catch pan 1610 of the stage-ball-inserting-mechanism 1600. Then, a player pushes the button 160, by which the control device 601 outputs the ball inserting order to the control device 611 of the control unit 610 in the satellite drawing device 1000 at a timing when the control device 601 receives its button operating signal. Thereby, the ball B1 is inserted via the ball inserting channel 1110 into the outer bingo stage 1100 to carry out the physical drawing. Where the direct satellite combination is awarded, the control device 601 decides that the start condition of the bingo game are satisfied and starts the bingo game to be described later (S20).

Furthermore, where the direct center combination is awarded (S16), the control device 601 outputs an order for starting a jackpot game via the control unit 610 of the satellite drawing device 1000 to the control device 621 of the control unit 620 in the center drawing device 2000. Thereby, the jackpot game is started in the center drawing device 2000 to be described later (S40).

(Flow of Bingo Game)

Next, a description is given of a flow of the bingo game which progresses in the pusher game machine 1 in the present embodiment.

Figure 22:
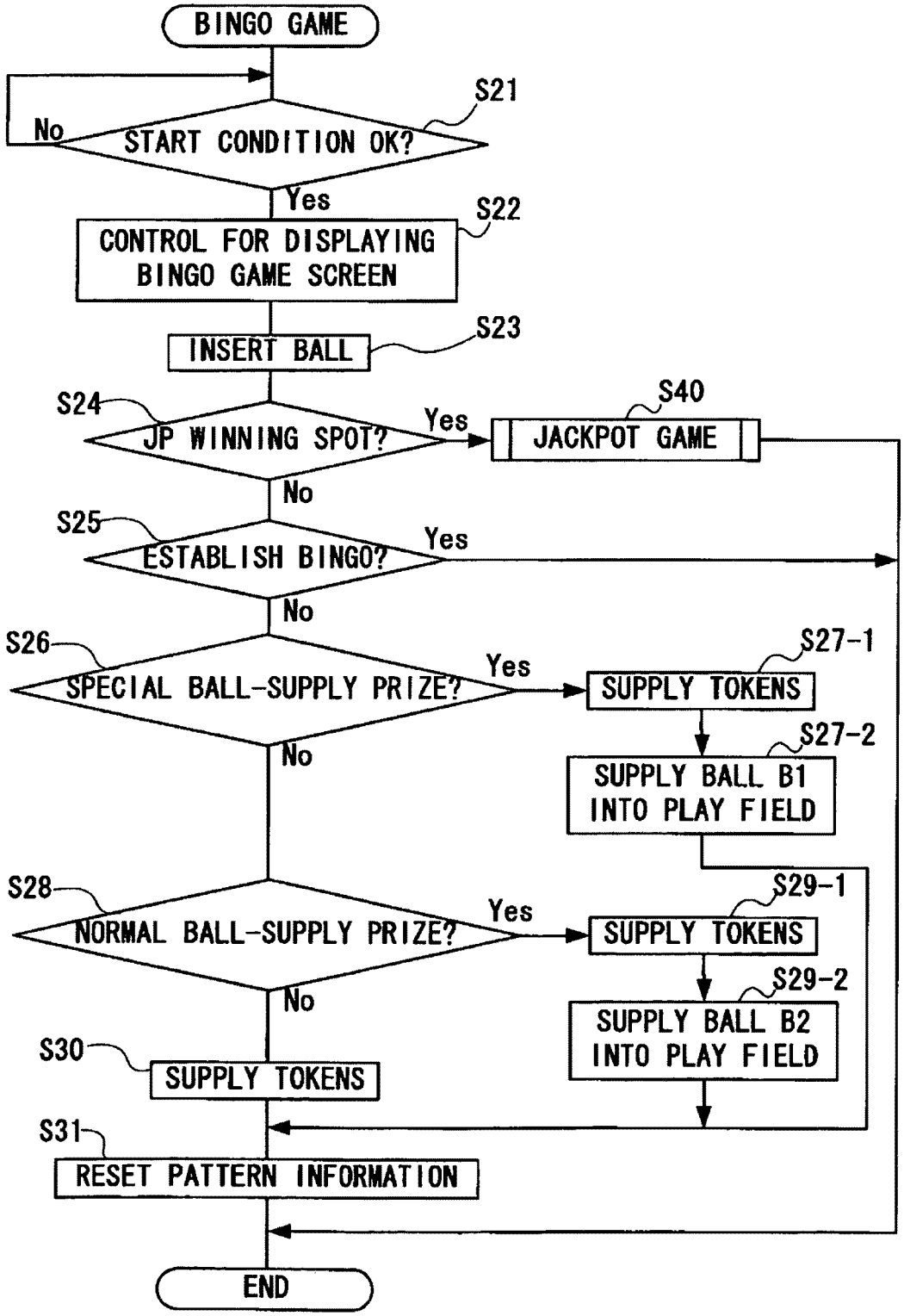
FIG. 22 is a flow chart showing a flow of a bingo game carried out in the pusher game machine.

FIG. 22 is a flow chart showing the flow of the bingo game in the present embodiment.

In the bingo game of the present embodiment, when the start condition of the bingo game are satisfied, in which the ball B1 or B2 falls to the token dropping groove or the direct satellite combination is awarded in the above-described slot game (S21), the control device 601 of the control unit 600 in the station unit ST executes a bingo execution program stored at the ROM 602, thereby starting the bingo game. More specifically, the control device 601 first carries out a display control so as to switch the slot game screen, shown in FIG. 6, displayed on the display unit 700 to the bingo game screen shown in FIG. 7 (S22). At this time, the bingo card image BC on the bingo game screen is based on pattern information generated at an arbitrary timing in the past. The pattern information is generated at a timing, for example, when the power supply of the pusher game machine 1 is turned on, a reset button (not illustrated) is pushed, or BINGO is established in preceding bingo games. In the present embodiment, a description is given of a case where on establishment of BINGO in the bingo game, new pattern information is generated and then changed to the preceding pattern information.

Further, the control device 601 outputs a bingo starting order to the control device 611 of the control unit 610 in the satellite drawing device 1000 when the start condition of the bingo game are satisfied. Thereby, the control device 611 moves the ball carrier 1520 to a position opposite to an outlet of the ball-conveying-unit-running-slope 1901 in the ball conveying mechanism 1900 of the station unit ST that has received the order. Then, the control device 601 controls the ball conveying mechanism 1900, thereby transferring the ball B1 or B2, which has fallen to the token dropping groove, from the ball-conveying-unit-running-slope 1901 to the ball carrier 1520. Thereafter, as described above, the control device 611 of the control unit 610 in the satellite drawing device 1000 moves the ball carrier 1520 to a position opposite to the stage-ball-inserting-mechanism 1600, controlling the stage-ball-inserting-mechanism 1600 according to the type of the balls B1 and B2, thus inserting the ball B1 or B2 into the outer bingo stage 1100 or the inner bingo stage 1200 (S23).

When the ball B1 or B2 which has been inserted into the outer bingo stage 1100 or the inner bingo stage 1200 enters into any one of winning spots 1101 and 1201, the signal thereof is sent to the control device 611 of the control unit 610 in the satellite drawing device 1000. Thereby, the control device 611 is able to recognize which of the winning spots 1101 and 1201 the ball B1 or B2 has entered into. At this time, if the winning spot 1101 or 1201 into which the ball B1 or B2 has entered is a JP winning spot to which a right for starting the jackpot game in the center drawing device 2000 is allocated (Yes in S24), the control device 611 outputs the order for starting the jackpot game to the control device 621 of the control unit 620 in the center drawing device 2000. Thereby, the jackpot game is started in the center drawing device 2000 (S40).

On the other hand, if the winning spot 1101 or 1201 into which the ball B1 or B2 has entered is a winning spot to which the bingo number is allocated (No in S24), the control device 611 of the control unit 610 in the satellite drawing device 1000 outputs information indicating the thus allocated bingo number to the control device 601 of the control unit 600 in the station unit ST which satisfies the start condition of the bingo game. The control device 601 that has received the information stores the bingo number related to the information as a winning bingo number at a winning-bingo-number storing area of the RAM 603 as a storage unit functioning as storage means. In addition, winning bingo numbers since the generation of pattern information corresponding to the station unit ST are cumulatively stored at the winning-bingo-number storing are a. Then, the control device 601, which is a decision unit, functions as decision means and carries out a bingo decision whether patterns of all the winning bingo numbers on a card pattern (a drawing object pattern) that is a pattern of bingo numbers of "1" to "9" on the bingo card indicated by the pattern information are a specific pattern or not by referring to all the winning bingo numbers stored at the winning-bingo-number storing area and the pattern information stored at a pattern-information storing area of the RAM 603 (S25). In addition, there are a total of eight rows that are vertical, horizontal and diagonal rows on a bingo card consisting of 3 rows and 3 columns, as the specific patterns in the present embodiment.

In the present embodiment, any one of the following prizes, that is, a token payout prize that a predetermined number of tokens are paid out to the play field 500, an normal ball-supply prize that the ball B1 is supplied to the play field 500 and a special ball-supply prize that the ball B2 is supplied to the play field 500, is allocated to each of the specific patterns. In the above bingo decision, where the control device 601 decides that it is not a specific pattern, that is, BINGO is not established (No in S25), the bingo game is finished.

On the other hand, where the control device 601 decides that BINGO is established (Yes in S25) and its specific pattern is related to the special ball-supply prize (Yes in S26), the control device 601 supplies a predetermined number of tokens M to the play field 500 by the same method as a case that the token supply combination such as the minor-combination A is awarded in the above-described slot game (S27-1). Also, the control device 601 supplies the ball B2 to the play field 500 by the same method as a case that the ball supply combination is awarded in the above-described slot game (S27-2).

Further, where the specific pattern in which BINGO has been established is related to the normal ball-supply prize (Yes in S28), the control device 601 supplies a predetermined number of tokens M to the play field 500 by the same method as a case that the token supply combination such as the minor-combination A is awarded in the above-described slot game (S29-1). Also, the control device 601 supplies the ball B1 to the play field 500 by the same method as a case that the ball supply combination is awarded in the above-described slot game (S29-2).

Still further, where the specific pattern in which BINGO has been established is related to the token supply prize (No in S28), the control device 601 supplies a predetermined number of tokens M to the play field 500 by the same method as a case that the token supply combination such as the minor-combination A is awarded in the above-described slot game (S30).

In addition, the number of tokens M supplied to the play field 500 on establishment of BINGO may be the number different in each of the prizes related to the establishment of BINGO or may be the same number.

After the control device 601 has executed the process after establishment of BINGO as described above, the control device 601, which is the pattern-information generating unit, functions as pattern-information generating means, executing a pattern-information generating program stored at the ROM 602 to generate new pattern information. Thereby, the pattern information stored in a pattern-information storage area of the RAM 603 changes to the thus generated new pattern information to reset the pattern information (S31).

(Flow of Jackpot Drawing)

Next, a description is given of the flow of the jackpot game in the present pusher game machine 1, which is a feature of the present invention.

Figure 1:
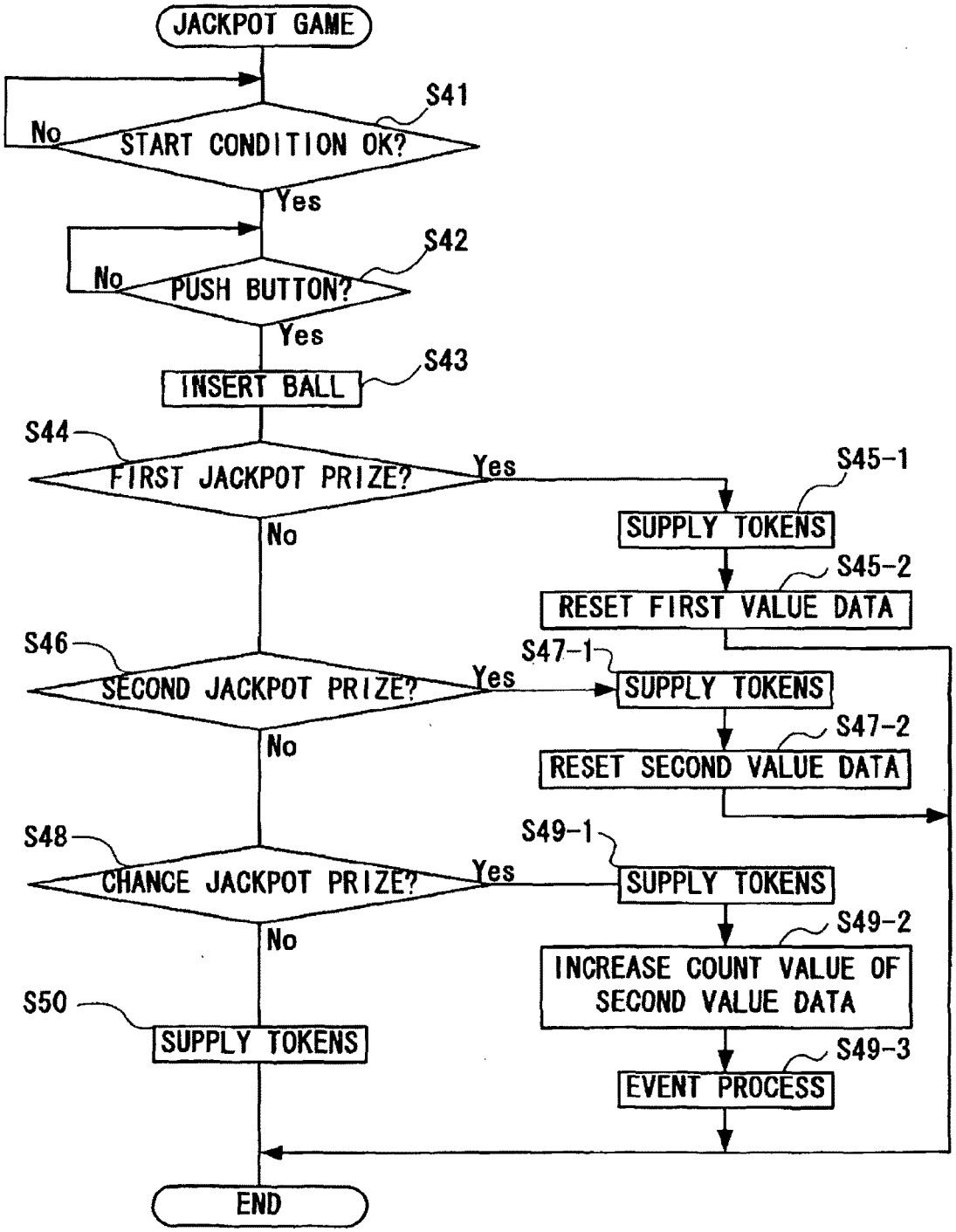
FIG. 1 is a flow chart showing a flow of a jackpot game carried out in a pusher game machine according to the embodiment.

FIG. 1 is a flow chart showing the flow of the jackpot game in the present embodiment.

In the jackpot game of the present embodiment, where the start condition of the jackpot game is satisfied (S41), that is, the ball B1 or B2 enters into the winning spot to which a right for starting the jackpot game in the center drawing device 2000 is allocated by the physical drawing in the satellite drawing device 1000 of the above-described bingo game, or the direct center combination is awarded in the above-described slot game, the control device 621 of the control unit 620 in the center drawing device 2000 execute a jackpot execution program stored in the ROM 622 to start the jackpot game. More specifically, the control device 621 controls for driving so that the device supporting base 2200 rotates and thereby the front of the center drawing device 2000 faces the satellite unit SA including the station unit ST that satisfies the start condition of the jackpot game. Further, the control device 621 makes the display device 2300 display a performance screen of the jackpot game, and controls the display device 2300 for displaying.

Thereafter, when a player who plays at the above station unit ST pushes the button 160 of the station unit ST (S42), its button operating signal is input into the control device 601 of the control unit 600 in the station unit ST. Thereby, the control device 601 outputs the ball inserting order to the control device 621 of the control unit 620 in the center drawing device 2000 via the control unit 610 of the satellite drawing device 1000. Thereby, the control device 621 outputs the ball inserting order to the large-ball-inserting-mechanism 2500. The large-ball-inserting-mechanism 2500 that has received the ball inserting order moves the ball stopper 2521 from the ball retaining position to the ball releasing position and inserts the large drawing ball 2400 retained at the ball retaining part 2520 into the transfer slope 2600 (S43). Thereby, the large drawing ball 2400 moves like a pendulum on the transfer slope 2600 around the lowest point thereof, and finally enters into any one of the retention spaces F of the rotational transfer device 2100. When the large drawing ball 2400 enters into any one of the retention spaces F, its signal is sent to the control device 621 of the control unit 620 in center drawing device 2000. Thereby, the control device 621 is able to recognize the retention space F into which the large drawing ball 2400 has entered.

At this time, where the retention space F into which the large drawing ball 2400 has entered is allocated the first jackpot prize JP1 (Yes in S44), the control device 621, which is a payout processing unit, functions as payout processing means and executes processing for reading out the first value data, which is payout amount data, from the RAM 623 which is a storage unit functioning as storage means, and for supplying the number of tokens M indicated by a count value of the first value data to the play field 500 of the station unit ST which has satisfied the start condition of the jackpot game (S45-1). At this time, the token supply order may be output from the control device 621 to the control device 601 of the control unit 600 in the station unit ST to supply tokens M to the play field 500 under the control of the control device 601 by the same method as the above-described normal token supply process. However, the number of tokens supplied when the first jackpot prize JP1 is awarded is such that the number of tokens (for example, 0.03 pieces) corresponding to part of the number of tokens inserted into all the station units ST is cumulatively added from a time when the first value data is reset to an initial value (for example, 500 pieces), therefore, it is a great number. For this reason, a token supply process using an original token supply mechanism may be used for this token supply process in separation from the above-described normal token supply process. This is also preferable as a performance made in a case where the first jackpot prize JP1 is awarded. Further, the control device 621 resets the first value data stored at the RAM 623 to the initial value (S45-2).

Still further, where the retention space F into which the large drawing ball 2400 has entered is allocated the second jackpot prize JP2 (Yes in S46), the control device 621, which is a payout processing unit, functions as payout processing means and executes processing for reading out the second value data, which is payout amount data, from the RAM 623 which is a storage unit functioning as storage means, and for supplying the number of tokens M indicated by a count value of the second value data to the play field 500 of the station unit ST which has satisfied the start condition of the jackpot game (S47-1). At this time, the token supply order may be output from the control device 621 to the control device 601 of the control unit 600 in the station unit ST to supply tokens M to the play field 500 under the control of the control device 601 by the same method as the above-described normal token supply process. However, the number of tokens supplied when the second jackpot prize JP2 is awarded is such that a predetermined number of tokens (for example, 100 pieces) are cumulatively added every time the chance pocket prize CP is awarded by the jackpot game from a time when the second value data is reset to an initial value (for example, 500 pieces), therefore, it is a great number. For this reason, a token supply process using an original token supply mechanism may be used for this token supply process in separation from the above-described normal token supply process. This is also preferable as a performance made in a case where the second jackpot prize JP2 is awarded. Further, the control device 621 resets the second value data stored at the RAM 623 to the initial value (S47-2).

On the other hand, where the retention space F into which the large drawing ball 2400 has entered is allocated the chance pocket prize CP (Yes in S48), the control device 621 outputs the token supply order to the control device 601 of the control unit 600 in the station unit ST which satisfies the start condition of the jackpot game. Accordingly, a predetermined number of tokens M (for example, 100 pieces) are supplied to the play field 500 of the station unit ST by the same method as a case that the token supply combination such as the minor-combination A is awarded in the above-described slot game (S49-1).

Also, where the retention space F into which the large drawing ball 2400 has entered is allocated the chance pocket prize CP (Yes in S48), the control device 621, which is a payout-amount increasing unit, functions as payout-amount increasing means and also executes a process for cumulatively increasing a count value (jackpot value) of the second value data stored at the RAM 623 only by a predetermined amount (for example, 100 pieces) (S49-2).

In the present embodiment, as described above, the payout increasing condition of the first jackpot prize JP1 is that a token is inserted into any one of the station units ST, whereas, also as described above, the payout increasing condition of the second jackpot prize JP2 is that the chance pocket prize CP is awarded by the jackpot game. Thus, the payout increasing conditions of each of the jackpot prizes JP1 and JP2 are set so as to be mutually different, whereby making it possible to diversify a condition for increasing the jackpot value of the jackpot prizes JP1 and JP2 and also improve the game attractiveness.

Further, in the present embodiment, the chance pocket prize CP capable of increasing the jackpot value of the second jackpot prize JP2 is included in prizes of jackpot game. If the chance pocket prize CP is awarded, a token supply amount (payout amount) obtained when the second jackpot prize is awarded in a subsequent jackpot game will be increased. Therefore, it is beneficial to all players to win the chance pocket prize CP. In a conventional jackpot game in which this prize is not included, a player only desires that others will not win the jackpot prize by the jackpot game. On the other hand, as in the present embodiment in which the chance pocket prize CP is provided, a player not only desires that others will not win the jackpot prize by the jackpot game but also desires that they can win the chance pocket prize CP by the jackpot game. As a result, the player becomes more interested in jackpot games of players other than the player himself, by which the game attractiveness can be enhanced for players other than the player who plays a jackpot game.

Still further, where the retention space F into which the large drawing ball 2400 has entered is allocated the chance pocket prize CP (Yes in S48), the control device 621 outputs an event starting order to the control device 611 of the control unit 610 in the satellite drawing device 1000 of the satellite unit SA to which the station unit ST belongs. The control device 611 which has received the order decides that a predetermined event condition has been satisfied and executes an event process in which during a subsequent predetermined event period, a winning bingo number selected by the physical drawing of the bingo game carried out at any one of four station units ST belonging to the satellite unit SA is handled as a winning bingo number also in the other three station units ST (S49-3). More specifically, the control device 611 outputs information indicating the winning bingo number selected in the physical drawing by the satellite drawing device 1000 carried out during the predetermined event period to the control device 601 of the control unit 600 in all the station units ST belonging to the satellite unit SA.

In addition, where the retention space F into which the large drawing ball 2400 has entered is allocated the token supply prizes M100 or M500 (No in S48), the control device 621 outputs the token supply order for supplying the number of tokens corresponding to the type of the token supply prizes M100 and M500 to the control device 601 of the control unit 600 in the station unit ST which has satisfied the start condition of the jackpot game. Accordingly, a predetermined number of tokens M (100 pieces or 500 pieces) are supplied to the play field 500 of the station unit ST by the same method as a case that the token supply combination such as the minor-combination A is awarded in the above-described slot game (S50).

As described above, in the present embodiment, even if a player who plays at any one of the station units ST wins the first jackpot prize JP1, the second value data related to the second jackpot prize JP2 will not be reset. Similarly, even if a player who plays at any one of the station units ST wins the second jackpot prize JP2, the first value data related to the first jackpot prize JP1 will not be reset. In other words, after either of the jackpot prizes is won by a certain player, the jackpot value of another jackpot prize is kept as it is. Therefore, where a certain player wins either of the jackpot prizes, remaining players are less desirous of winning this jackpot prize but have a strong desire to win another jackpot prize. As a result, the game attractiveness of other player is not reduced at all even if a certain player has won either of the jackpot prizes. On the contrary, such an effect that the game attractiveness is further enhanced is expected.

In the present embodiment, a description was given of a case in which the center drawing device 2000, which is a drawing machine for jackpot game, is installed in the pusher game machine 1 that is a game machine including a plurality of the station units ST at which mutually independent pusher games progress, and when the start condition of the jackpot game is satisfied at any one of the station units ST, the jackpot game is started at the center drawing device 2000. However, the present invention is not limited to the above-described case.

The present invention is not limited to a plural-player play type game machine as described in the present embodiment in which a plurality of players play at the same time but applicable to a single-player play type game machine.

The present invention is also applicable, for example, to a game system in which a plurality of game machines are connected to a drawing machine for jackpot game via a communication network and when the start condition of the jackpot game is satisfied in any of the game machines, the drawing machine for jackpot game starts the jackpot game.

Further, in the present embodiment, a description was given of a case where as a drawing unit functioning as drawing means for carrying out the jackpot game, a drawing mechanism which carried out the physical drawing using the drawing moving object called the large drawing ball 2400 was exemplified. However, the present invention is not limited to the above case and may include a case where a digital drawing is carried out to decide whether any jackpot prize is awarded or not based on a drawing program using random numbers.

In the present embodiment, a description was also given of a case where two types of jackpot prizes JP1 and JP2 are mutually different in payout-amount increasing conditions. However, the payout-amount increasing conditions may be the same. For example, both of the conditions of the jackpot prizes JP1 and JP2 may be a condition that a token is inserted into any one of the station units ST, a condition that the chance pocket prize CP is awarded by the jackpot game, or any other conditions. In addition, under the same payout-amount increasing conditions, an amount to be increased when the conditions are satisfied may be set to be different, depending on a type of the jackpot prizes.

Still further, in the above embodiment, means realized by software such as computer programs may be realized by using hardware such as circuits and chips. Also, means realized by hardware such as circuits and chips may be realized by software such as computer programs.

The invention claimed is:

1. A drawing machine for jackpot game having a drawing unit for carrying out a drawing to decide a winning for which any one of a plurality of types of jackpot prizes is awarded or a non-winning for which none of the plurality of types of jackpot prizes is awarded, comprising:

a storage unit for storing, by the plurality of types of jackpot prizes, payout amount data indicating an amount of payout-objects to be paid out to a player when the drawing unit decides that any one of the plurality of types of jackpot prizes is awarded;

a payout processing unit for executing a payout process in which, when the drawing unit decides that any one of the plurality of types of jackpot prizes is awarded, payout amount data corresponding to the type of the awarded jackpot prize is read from the storage unit and an amount of payout-objects indicated by the read payout amount data is paid out to the player, and for executing a data process of a plurality of pieces of payout amount data stored in the storage unit such that after the payout amount data corresponding to the type of the awarded jackpot prize is read from the storage unit, while a payout amount decreasing process for decreasing an amount indicated by the payout amount data stored in the storage unit is executed, amounts corresponding to payout amount data other than the read payout amount data is not decreased in the payout amount decreasing process; and a payout-amount increasing unit for increasing cumulatively an amount indicated by at least one of the plurality of payout amount data stored in the storage unit when a predetermined payout increasing condition is satisfied.

2. The drawing machine for jackpot game according to claim 1, wherein the non-winning which can be decided by the drawing unit includes a payout-amount increasing prize, and the payout-amount increasing unit cumulatively increases an amount indicated by the at least one of the plurality of payout amount data stored in the storage unit when the payout increasing condition in which the drawing unit decides the payout-amount increasing prize is satisfied.

3. The drawing machine for jackpot game according to claim 1, wherein the payout increasing condition comprises two or more of payout increasing conditions which are different from each other, and when any one of the two or more of the payout increasing conditions is satisfied, the payout-amount increasing unit cumulatively increases an amount indicated by the payout amount data corresponding to the satisfied payout increasing condition among the plurality of pieces of payout amount data stored in the storage unit.

4. The drawing machine for jackpot game according to claim 2, wherein the payout increasing condition comprises two or more of payout increasing conditions which are different from each other, and when any one of the two or more of the payout increasing conditions is satisfied, the payout-amount increasing unit cumulatively increases an amount indicated by the payout amount data corresponding to the satisfied payout increasing condition among the plurality of pieces of payout amount data stored in the storage unit.

5. A game machine, comprising:

a drawing machine for jackpot game having a drawing unit for carrying out a drawing to decide a winning for which any one of a plurality of types of jackpot prizes is awarded or a non-winning for which none of the plurality of types of jackpot prizes is awarded, and a game control unit for controlling progression of a game, wherein the drawing machine comprises a storage unit for storing, by the plurality of types of jackpot prizes, payout amount data indicating an amount of payout-objects to be paid out to a player when the drawing unit decides that any one of the plurality of types of jackpot prizes is awarded, a payout processing unit for executing a payout process in which, when the drawing unit decides that any one of the plurality of types of jackpot prizes is awarded, payout amount data corresponding to the type of the awarded jackpot prize is read from the storage unit and an amount of payout-objects indicated by the read payout amount data is paid out to the player, and for executing a data process of a plurality of pieces of payout amount data stored in the storage unit such that after the payout amount data corresponding to the type of the awarded jackpot prize is read from the storage unit, while a payout amount decreasing process for decreasing an amount indicated by the payout amount data stored in the storage unit is executed, amounts corresponding to payout amount data other than the read payout amount data is not decreased in the payout amount decreasing process, and a payout-amount increasing unit for increasing cumulatively an amount indicated by at least one of the plurality of payout amount data stored in the storage unit when a predetermined payout increasing condition is satisfied, wherein the drawing unit starts the above drawing when a predetermined drawing start condition is satisfied by a progression of the game controlled by the game control unit.

6. The game machine according to claim 5, further comprising: a plurality of gaming units, each of which has the game control unit, wherein games are allowed to, independently on each other, progress by the game progress unit, wherein the payout processing unit of the drawing machine for jackpot game executes a payout process for paying out an amount of the payout-objects indicated by the payout amount data read from the storage unit to player of the gaming unit which satisfies the predetermined drawing start condition when the drawing unit of the drawing machine for jackpot game decides the winning in which any one of the plurality of types of jackpot prizes is awarded.

7. The drawing machine according to claim 5, wherein the non-winning which can be decided by the drawing unit includes a payout-amount increasing prize, and the payout-amount increasing unit cumulatively increases an amount indicated by the at least one of the plurality of payout amount data stored in the storage unit when the payout increasing condition in which the drawing unit decides the payout-amount increasing prize is satisfied.

8. The drawing machine according to claim 7, wherein the payout increasing condition comprises two or more of payout increasing conditions which are different from each other, and when any one of the two or more of the payout increasing conditions is satisfied, the payout-amount increasing unit cumulatively increases an amount indicated by the payout amount data corresponding to the satisfied payout increasing condition among the plurality of pieces of payout amount data stored in the storage unit.

9. The drawing machine according to claim 5, wherein the payout increasing condition comprises two or more of payout increasing conditions which are different from each other, and when any one of the two or more of the payout increasing conditions is satisfied, the payout-amount increasing unit cumulatively increases an amount indicated by the payout amount data corresponding to the satisfied payout increasing condition among the plurality of pieces of payout amount data stored in the storage unit.

10. A game system, comprising:

a drawing machine for jackpot game having a drawing unit for carrying out a drawing to decide a winning for which any one of a plurality of types of jackpot prizes is awarded or a non-winning for which none of the plurality of types of jackpot prizes is awarded; and a plurality of game machines, each of which is connected to the drawing device via a communication network and has a game control unit for controlling progression of a game, wherein the drawing machine comprises a storage unit for storing, by the plurality of types of jackpot prizes, payout amount data indicating an amount of payout-objects to be paid out to a player when the drawing unit decides that any one of the plurality of types of jackpot prizes is awarded, a payout processing unit for executing a payout process in which, when the drawing unit decides that any one of the plurality of types of jackpot prizes is awarded, payout amount data corresponding to the type of the awarded jackpot prize is read from the storage unit and an amount of payout-objects indicated by the read payout amount data is paid out to the player, and for executing a data process of a plurality of pieces of payout amount data stored in the storage unit such that after the payout amount data corresponding to the type of the awarded jackpot prize is read from the storage unit, while a payout amount decreasing process for decreasing an amount indicated by the payout amount data stored in the storage unit is executed, amounts corresponding to payout amount data other than the payout amount data is not decreased in the payout amount decreasing process, and a payout-amount increasing unit for increasing cumulatively an amount indicated by at least one of the plurality of payout amount data stored in the storage unit when a predetermined payout increasing condition is satisfied, and wherein, the drawing unit starts the above drawing when a predetermined drawing start condition is satisfied by the progression of the game controlled by the game control unit of any one of the game machines, and the payout processing unit of the drawing machine for jackpot game executes a payout process for paying out an amount of payout-objects indicated by the payout amount data read from the storage unit to a player of the game machine which satisfies the predetermined drawing start condition when the drawing unit decides the winning in which any one of the plurality of types of jackpot prizes is awarded.

11. The game system according to claim 10, wherein the non-winning which can be decided by the drawing unit includes a payout-amount increasing prize, and the payout-amount increasing unit cumulatively increases an amount indicated by the at least one of the plurality of payout amount data stored in the storage unit when the payout increasing condition in which the drawing unit decides the payout-amount increasing prize is satisfied.

12. The game system according to claim 11, wherein the payout increasing condition comprises two or more of payout increasing conditions which are different from each other, and when any one of the two or more of the payout increasing conditions is satisfied, the payout-amount increasing unit cumulatively increases an amount indicated by the payout amount data corresponding to the satisfied payout increasing condition among the plurality of pieces of payout amount data stored in the storage unit.

13. The game system according to claim 10, wherein the payout increasing condition comprises two or more of payout increasing conditions which are different from each other, and when any one of the two or more of the payout increasing conditions is satisfied, the payout-amount increasing unit cumulatively increases an amount indicated by the payout amount data corresponding to the satisfied payout increasing condition among the plurality of pieces of payout amount data stored in the storage unit.

* * * * *